US008847837B2

(12) United States Patent
Hino et al.

(10) Patent No.: US 8,847,837 B2
(45) Date of Patent: Sep. 30, 2014

(54) ANTENNA AND RADAR APPARATUS

(75) Inventors: Akihiro Hino, Nishinomiya (JP); Koji Atsumi, Nishinomiya (JP)

(73) Assignee: FURUNO Electric Company Limited, Nishinomiya, Hyogo-Pref. (JP)

( * ) Notice: Subject to any disclaimer, the term of this patent is extended or adjusted under 35 U.S.C. 154(b) by 683 days.

(21) Appl. No.: 12/546,443

(22) Filed: Aug. 24, 2009

(65) Prior Publication Data

US 2010/0097283 A1 Apr. 22, 2010

(30) Foreign Application Priority Data

Oct. 20, 2008 (JP) ..... 2008-269796

(51) Int. Cl.
*H01Q 13/02* (2006.01)
*H01Q 9/28* (2006.01)

(52) U.S. Cl.
CPC ..... *H01Q 9/285* (2013.01); *H01Q 13/02* (2013.01)
USPC ..... 343/786

(58) Field of Classification Search
USPC ..... 343/772, 786, 793, 795, 801, 810
See application file for complete search history.

(56) References Cited

U.S. PATENT DOCUMENTS

| | | | | | |
|---|---|---|---|---|---|
| 3,325,816 | A | * | 6/1967 | Dutton | 343/777 |
| 3,698,000 | A | * | 10/1972 | Landry et al. | 343/772 |
| 4,087,822 | A | | 5/1978 | Maybell et al. | |
| 4,114,163 | A | * | 9/1978 | Borowick | 343/815 |
| 4,905,013 | A | * | 2/1990 | Reindel | 343/786 |
| 6,031,504 | A | | 2/2000 | McEwan | |

FOREIGN PATENT DOCUMENTS

| | | | |
|---|---|---|---|
| CN | 1996665 | A | 7/2007 |
| EP | 1887655 | A1 | 2/2008 |
| FR | 2690787 | A1 | 11/1993 |
| JP | 1-143508 | A | 6/1989 |
| JP | 5-206729 | A | 8/1993 |
| JP | 2005-072670 | A | 3/2005 |

OTHER PUBLICATIONS

British Examination Report under Section 18(3) dated Aug. 1, 2012 for British Application No. GB0913959.3.

* cited by examiner

*Primary Examiner* — Robert Karacsony
(74) *Attorney, Agent, or Firm* — Birch, Stewart, Kolasch & Birch, LLP

(57) ABSTRACT

This disclosure provides an antenna device that includes a horn having a deeper-side portion and an opening-side portion, a feeder line, and an antenna element that is supplied with electric power from the feeder line to generate an electric wave, and radiates the electric wave from the horn. The feeder line is arranged parallel to the radiating direction of the electric wave.

22 Claims, 16 Drawing Sheets

ANTENNA AND RADAR APPARATUS

CROSS-REFERENCE TO RELATED APPLICATION(S)

This application claims priority under 35 U.S.C. §119 to Japanese Patent Application No. 2008-269796, which was filed on Oct. 20, 2008, the entire disclosure of which is hereby incorporated by reference.

TECHNICAL FIELD

The present invention relates to an antenna and a radar apparatus.

BACKGROUND

Conventionally, many patch antenna (microstrip antenna) devices are used as antenna devices used for radar etc, for example, as disclosed in JP1993-206729(A).

The patch antenna device typically includes a dielectric substrate, a patch made of a thin-film conductor formed on one side of the dielectric substrate, a ground formed on the other side of the dielectric substrate, and a feeder line made of a thin-film conductor that is formed on the one side of the dielectric substrate and is coupled to the one end of the patch. Such a patch antenna device radiates an electromagnetic wave from the patch in a direction perpendicular to the substrate when electric power is supplied to the patch through the feeder line. However, such a patch antenna device radiates from the feeder line, that is located on the dielectric substrate as well as the patch, electromagnetic waves produced by current flowing through the feeder line (hereinafter, referred to as "disused radiations") in a direction perpendicular to the substrate. Therefore, because the electromagnetic waves from the patch and the disused radiations are radiated to the same direction, the electromagnetic waves radiated from the patch will be influenced by the disused radiations. As a result, it may be difficult to radiate electromagnetic waves having designed characteristics.

SUMMARY

Therefore, antenna devices capable of reducing the influences of the disused radiations radiated from the feeder line have been craved.

According to an aspect of the present invention, an antenna device includes a horn having a deeper-side portion and an opening-side portion, a feeder line, and an antenna element that is supplied with electric power from the feeder line to generate an electric wave, and radiates the electric wave from the horn. The feeder line is arranged parallel to the radiating direction of the electric wave.

When the electric power is supplied to the antenna element via the feeder line, the electromagnetic wave is radiated from the antenna element. Typically, the antenna element radiates the electromagnetic wave such that a radiated electric power to a direction perpendicular to an arranged direction of a pair of antenna elements will be the maximum. A part of electromagnetic wave radiated from the antenna element toward a direction intersecting with the open direction of the horn reflects on the inner surface of the horn and then travels toward the open direction of the horn, and thereby a beam width in a direction perpendicular to the open direction will be narrow. In a particular case, because the feeder line is arranged parallel to the radiating direction of the electric wave, the electric power of the electromagnetic wave radiated from the antenna element can be collected toward the open direction of the horn.

The feeder line may be formed on a substrate and the substrate may be arranged parallel to the open direction of the horn.

The antenna element may be a dipole antenna including a pair of antenna elements formed on the substrate.

The horn may include a shield portion for covering an area including the feeder line.

The shield portion may have a conductive member.

The shield portion may include a first conductive plate portion arranged so as to oppose to an area where the feeder line is formed, and a second conductive plate portion arranged so as to oppose to the first plate portion via the substrate.

The substrate may be provided to the second plate portion.

The horn may include a third plate portion coupled to end portions of the first plate portion and the second plate portion on the side opposite from the open direction of the horn.

A gap formed between the substrate and the first plate portion may be 1/10 of the wavelength or greater of the electromagnetic wave radiated from the dipole antenna.

At least a part of the feeder line may be covered with an insulator.

According to another aspect of the present invention, a radar apparatus includes a horn having a deeper-side portion and an opening-side portion, a feeder line, an antenna element that is supplied with electric power from the feeder line to generate an electric wave, and radiates the electric wave from the horn, and a reception portion for receiving a reflective wave of the electromagnetic wave from a target object. The feeder line is arranged parallel to the radiating direction of the electric wave.

When the electric power is supplied to the antenna element via the feeder line, the electromagnetic wave is radiated from the antenna element. Typically, the antenna element radiates the electromagnetic wave such that a radiated electric power to a direction perpendicular to an arranged direction of a pair of antenna elements will be the maximum. A part of electromagnetic wave radiated from the antenna element toward a direction intersecting with the open direction of the horn reflects on the inner surface of the horn and then travels toward the open direction of the horn, and thereby a beam width in a direction perpendicular to the open direction will be narrow. In a particular case, because the feeder line is arranged parallel to the radiating direction of the electric wave, the electric power of the electromagnetic wave radiated from the antenna element can be collected toward the open direction of the horn.

The feeder line may be formed on a substrate and the substrate may be arranged parallel to the open direction of the horn.

The antenna element may be a dipole antenna including a pair of antenna elements formed on the substrate.

The horn may include a shield portion for covering an area including the feeder line.

The shield portion may have a conductive member.

The shield portion may include a first conductive plate portion arranged so as to oppose to an area where the feeder line is formed, and a second conductive plate portion arranged so as to oppose to the first plate portion via the substrate.

The substrate may be provided to the second plate portion.

The horn may include a third plate portion coupled to end portions of the first plate portion and the second plate portion on the side opposite from the open direction of the horn.

The gap between the substrate and the first plate portion may be 1/10 or greater of the wavelength of the electromagnetic wave radiated from the dipole antenna.

At least a part of the feeder line may be covered with an insulator.

BRIEF DESCRIPTION OF THE DRAWINGS

The present disclosure is illustrated by way of example and not by way of limitation in the figures of the accompanying drawings, in which the like reference numerals indicate like elements and in which.

DETAILED DESCRIPTION

Hereinafter, antennas and radar apparatuses according to embodiments of the present invention will be described referring to the appended drawings.

First Embodiment

An antenna device 1 of this embodiment is typically used for radar of ships; however, it may not be limited to application to ships and may be used in any other applications widely.

Figure 1:
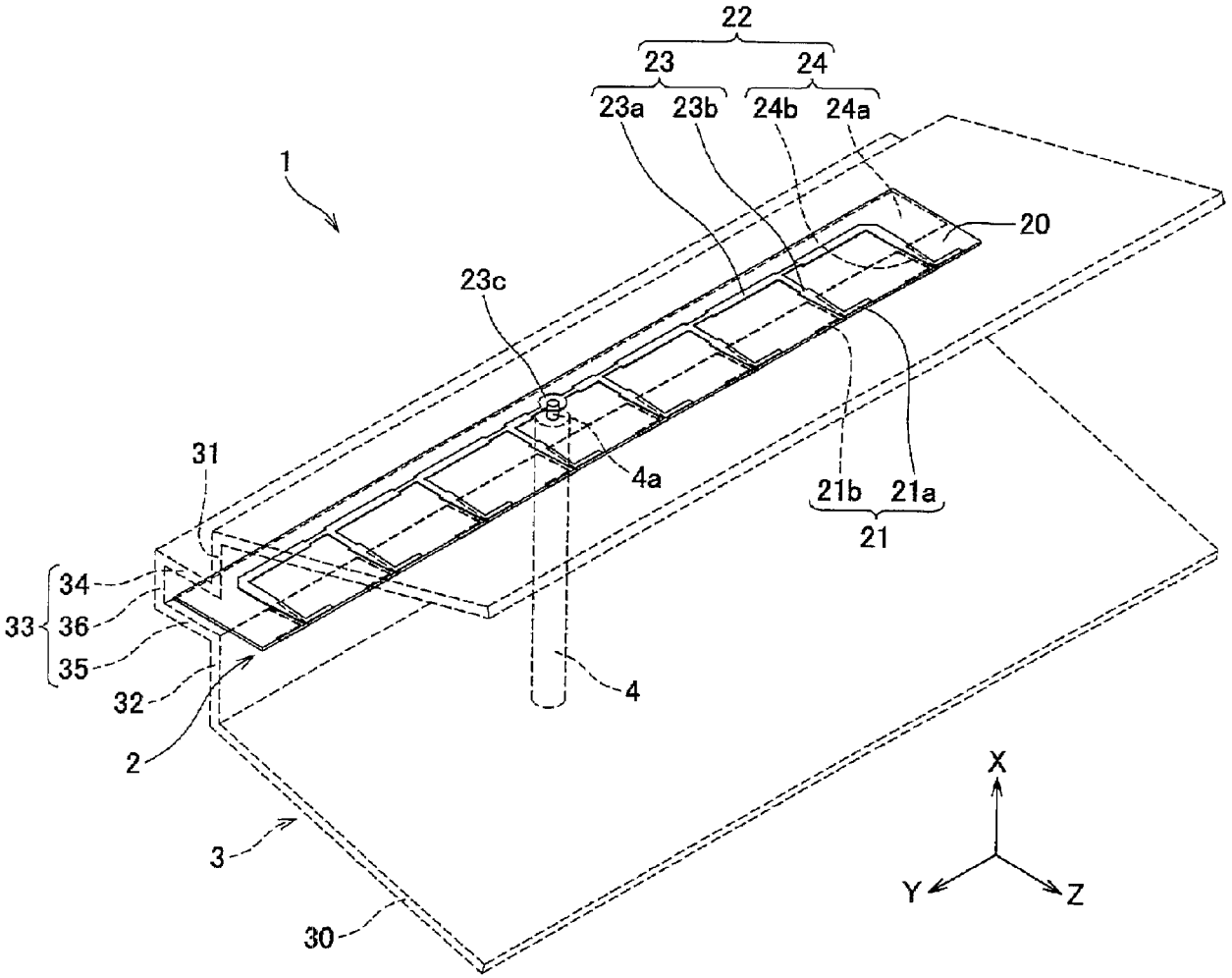
FIG. 1 is a perspective view of an antenna device according to a first embodiment of the present invention.

As shown in FIG. 1, the antenna device 1 includes a horn 3 having an opening, an antenna substrate (antenna module) 2 arranged in a deeper-side portion of the horn 3, and a feeder pipe 4. Here, the open direction of the horn 3 is defined as the z-axis direction (or front direction), the vertically upward direction with respect to the ground surface is defined as the x-axis direction, and the direction perpendicular to the z-axis and the x-axis is defined as the y-axis direction.

Figure 2:
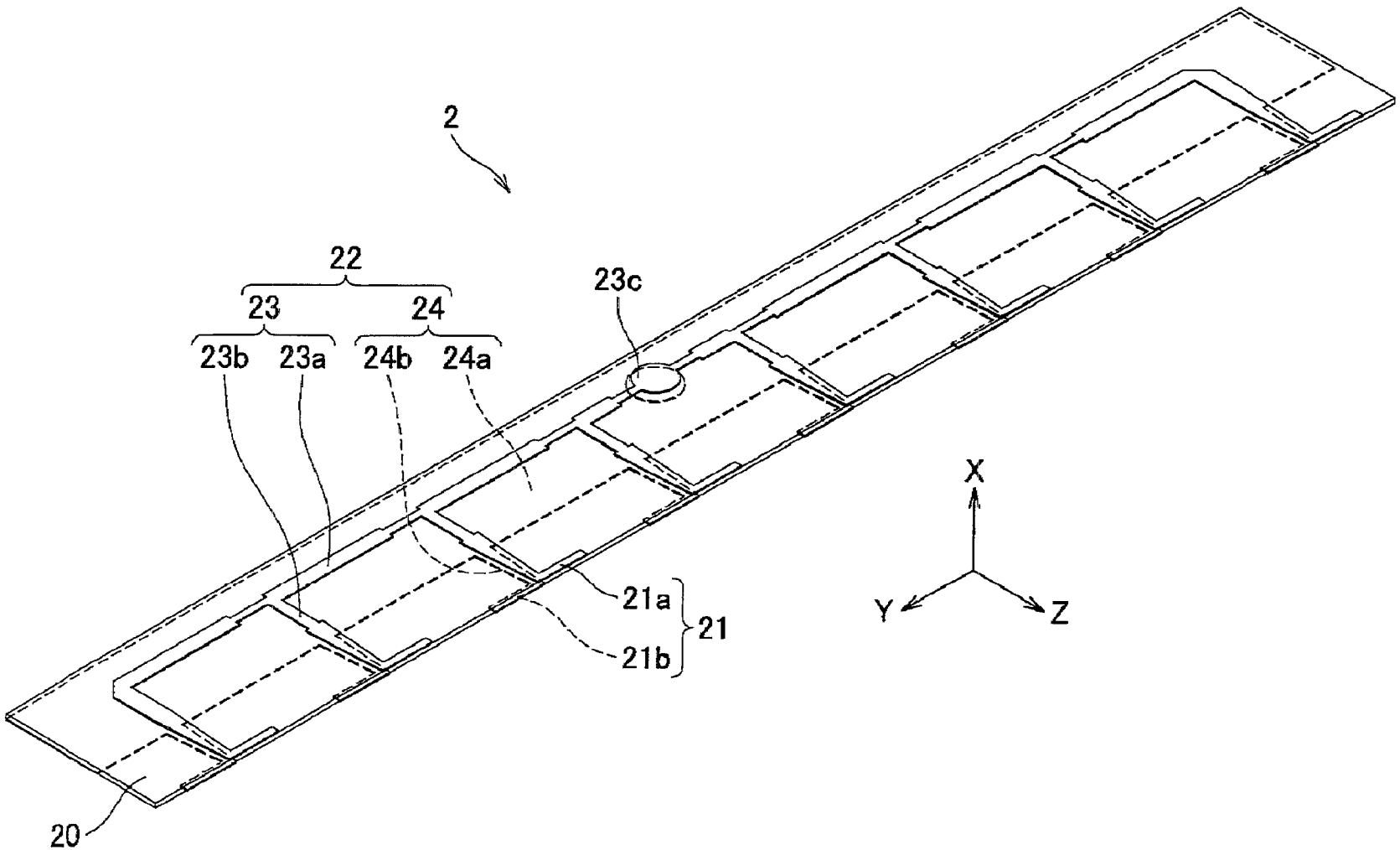
FIG. 2 is a perspective view of an antenna substrate.
Figure 3A:
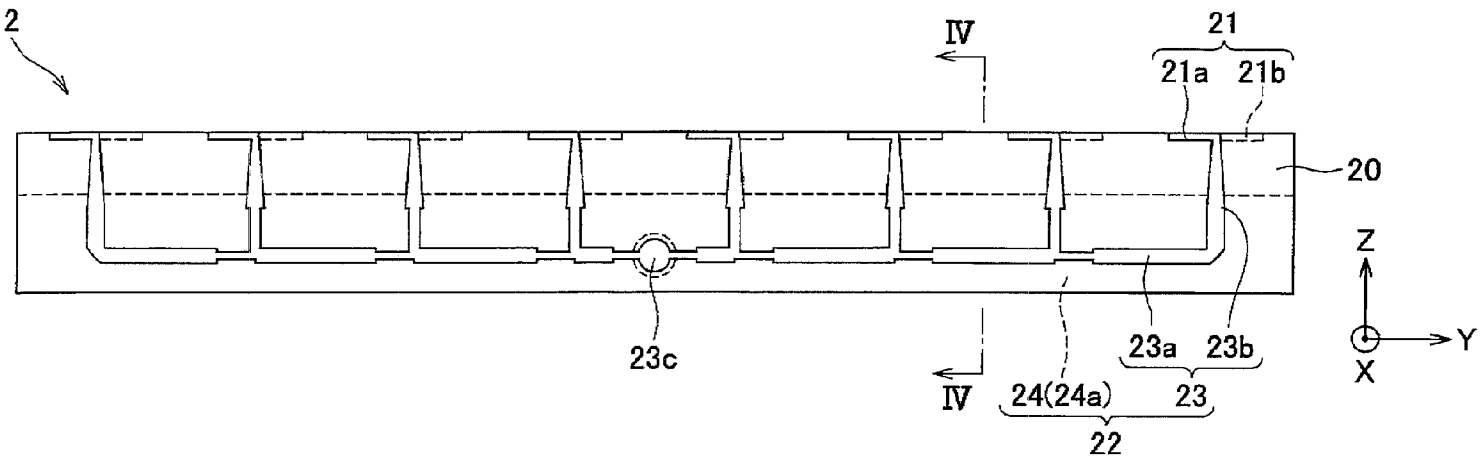
FIG. 3A is a plan view of the antenna substrate and FIG. 3B is a bottom view of the antenna substrate.
Figure 3B:
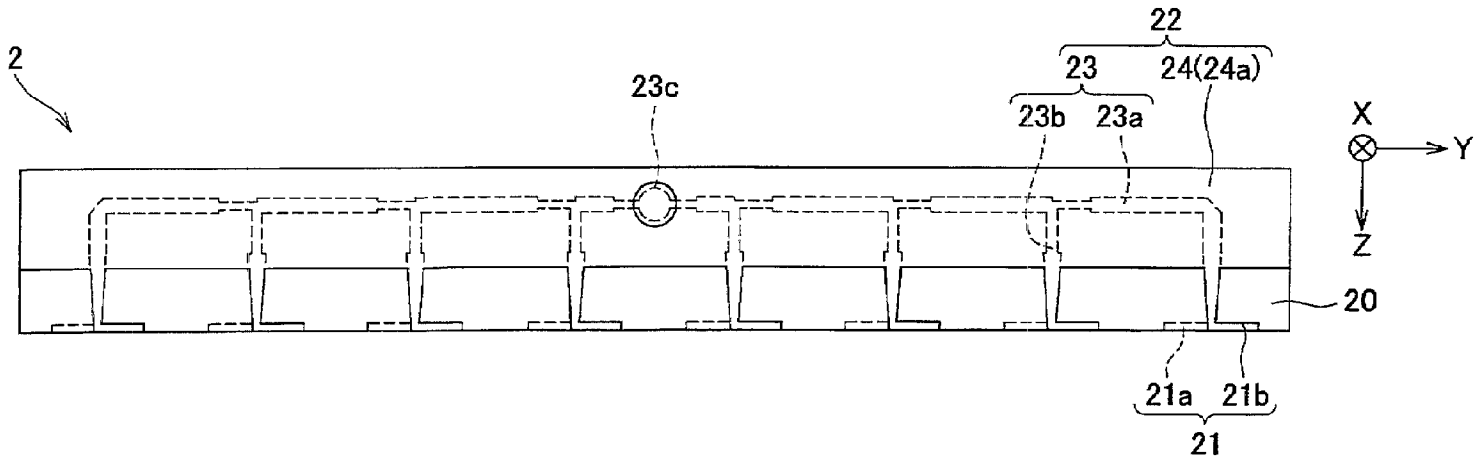

As shown in FIGS. 2, and 3A and 3B, the antenna substrate 2 includes a dielectric substrate 20, eight dipole antennas 21 formed on the dielectric substrate 20, and traces 22 formed on the dielectric substrate 20.

Figure 4:
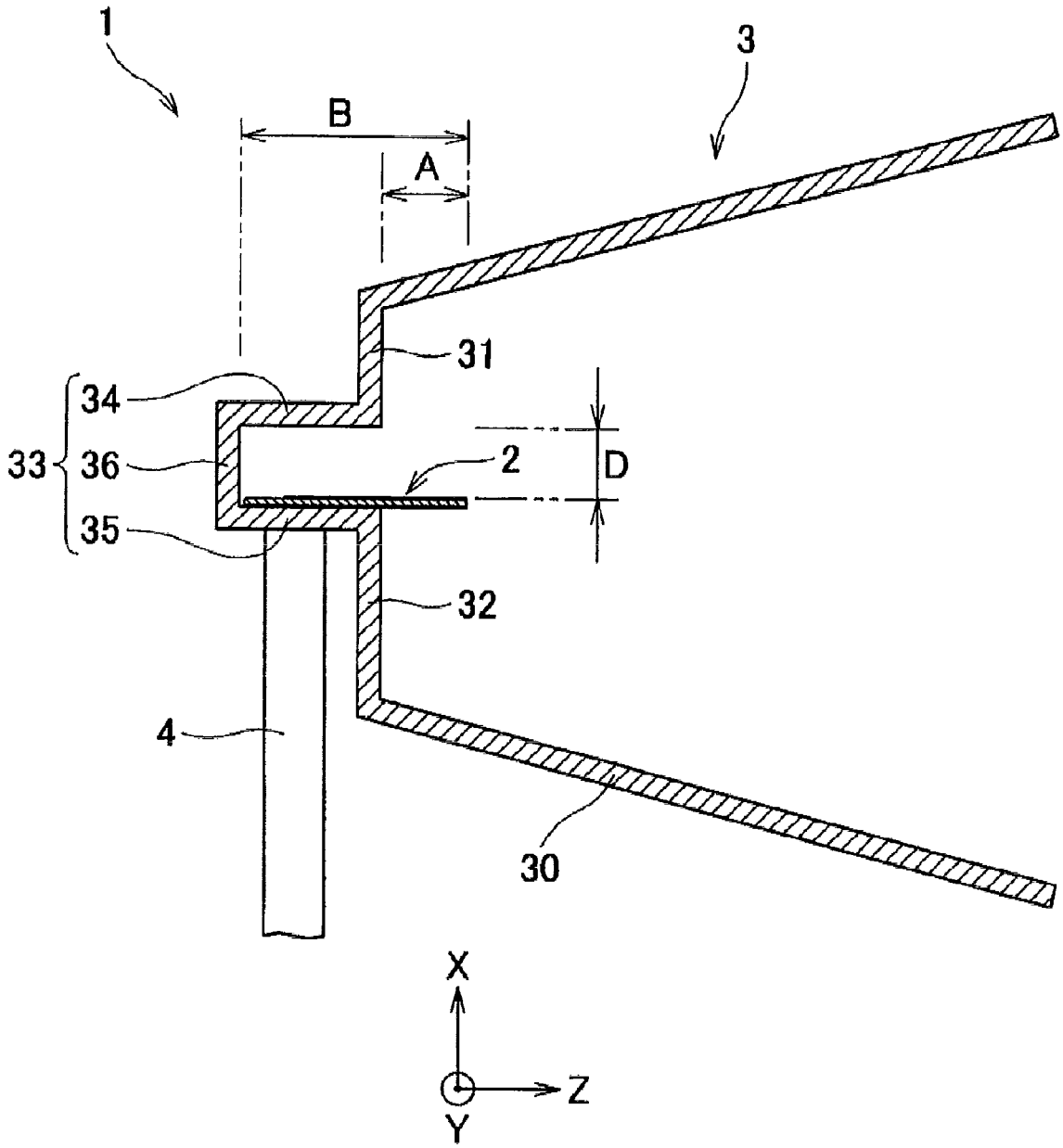
FIG. 4 is a cross-sectional view taken along a line IV-IV in FIG. 3A.

As shown in FIG. 4, the horn 3 includes a horn body 30 that forms the opening at an end, two reflectors 31 and 32 coupled to a base portion of the horn body 30, and a shield portion 33 formed between the two reflectors 31 and 32. The horn 3 is arranged such that its open direction is oriented to a direction parallel to the ground surface. The antenna substrate 2 is laid on a lower plate 35 of the shield portion 33, which will be described later.

Referring back to FIG. 2, the dielectric substrate 20 constitutes the contour of the antenna substrate 2. The dielectric substrate 20 is a thin-plate member of a rectangular shape elongated in the y-axis direction, and is arranged in parallel with the y-z plane. In a front end portion of the dielectric substrate 20, the eight dipole antennas 21 are arranged in the y-axis direction so as to be equally spaced from each other. In this embodiment, the number of the dipole antennas 21 may not be limited to eight, and may be any other number, such as one, or two or more.

The dipole antenna 21 is typically made of a thin-film conductor, such as a copper foil, and may be printed on the surface of the dielectric substrate 20. Generally, such a printed dipole antenna 21 is referred to as a "plane dipole antenna" or "print dipole antenna."

Figure 5:
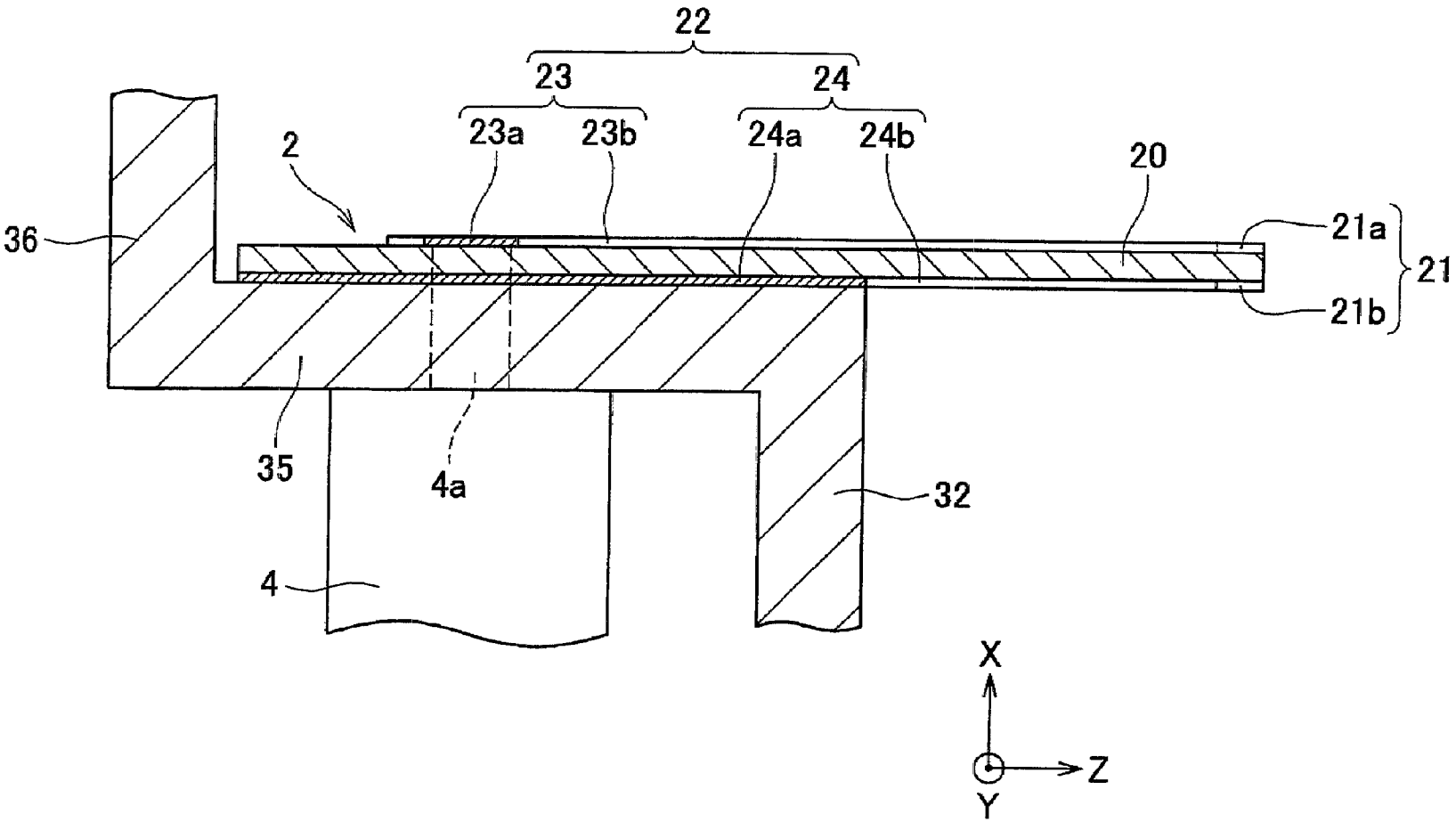
FIG. 5 is a partially enlarged view of FIG. 4.

Each of the dipole antennas 21 includes two (a pair of) antenna elements 21*a* and 21*b* symmetrically arranged about a straight line parallel to the z-axis. As shown in FIG. 5, the antenna element 21*a* is arranged on an upper surface of the dielectric substrate 20, and the antenna element 21*b* is arranged on a lower surface of the dielectric substrate 20.

The antenna elements 21*a* and 21*b* are formed substantially in a rectangular shape elongated in the y-axis direction. An end portion of the antenna element 21*a* extending to the plus side in the y-axis and an end portion of the antenna element 21*b* extending to the minus side in the y-axis oppose to each other via the dielectric substrate 20. Lengths of the antenna elements 21*a* and 21*b* in the y-axis direction are set to ¼ of a wavelength $\lambda$ of the electromagnetic waves radiated from the dipole antenna 21.

Normally, directivity of a dipole antenna is such that radiations in a direction perpendicular to the arranged direction of two antenna elements is the maximum (relation of the radiation angle and intensity of the electromagnetic wave). The radiation is zero in intensity in the arranged direction of the two antenna elements (in this embodiment, the plus direction and the minus direction in the y-axis direction).

As shown in FIGS. 2, and 3A and 3B, the traces 22 are formed behind the dipole antenna 21. Similar to the dipole antenna 21, the traces 22 are made of a thin-film conductor, such as a copper foil, and are printed on the surface of the dielectric substrate 20.

As shown in FIG. 5, the traces 22 include a feeder line 23 formed on the upper surface of the dielectric substrate 20, and a ground 24 formed on the lower surface of the dielectric substrate 20. The feeder line 23 and the ground 24 constitute so-called a "microstrip line."

The ground 24 includes a ground body 24*a* and eight connection lines 24*b*. The ground body 24*a* is formed in substantially a rear half area on the lower surface of the dielectric substrate 20. The connection lines 24*b* are formed to extend in the z-axis direction from the ground body 24*a*, and the tip end thereof is coupled to an end of the antenna element 21*b* on the minus side in the y-axis.

The feeder line 23 includes a trunk line 23*a* extending in the y-axis direction, and eight branch lines 23*b* branched from the trunk line 23*a*. The trunk line 23*a* is formed in a rear area on the upper surface of the dielectric substrate 20 (i.e., the back side of the ground body 24*a* in this embodiment). The eight branch lines 23*b* are branched from the trunk line 23*a*, and extended in the z-axis direction. The eight branch lines 23*b* are arranged at equal intervals in the y-axis direction. The tip end of the branch line 23*b* is coupled to an end of the antenna element 21*a* on the plus side in the y-axis. Therefore, the branch line 23*b* and the connection line 24*b* are arranged so to oppose to each other via the dielectric substrate 20.

A feeder portion 23*c* is formed at the center of the trunk line 23*a* in the y-axis direction. As shown in FIG. 1, a central conductor 4*a* of the feeder pipe 4 (described later) is connected to the feeder portion 23*c*. In this embodiment, although the feeder portion 23*c* is provided in the center portion of the trunk line 23*a*, it may be provided in an end portion of the trunk line 23*a*.

As shown in FIGS. 3A and 3B, widths of the trunk line 23*a* and the branch lines 23*b* are not constant but may vary. By changing the widths of the trunk line 23*a* and the branch lines 23*b*, the electric power supplied to the eight dipole antennas 21 may be adjusted.

Preferably, the feeder line 23 may be or may not be covered with an insulator, such as a synthetic resin, depending on the size of a gap D (see FIG. 4, described later) or the electric power to supply.

Figure 6:
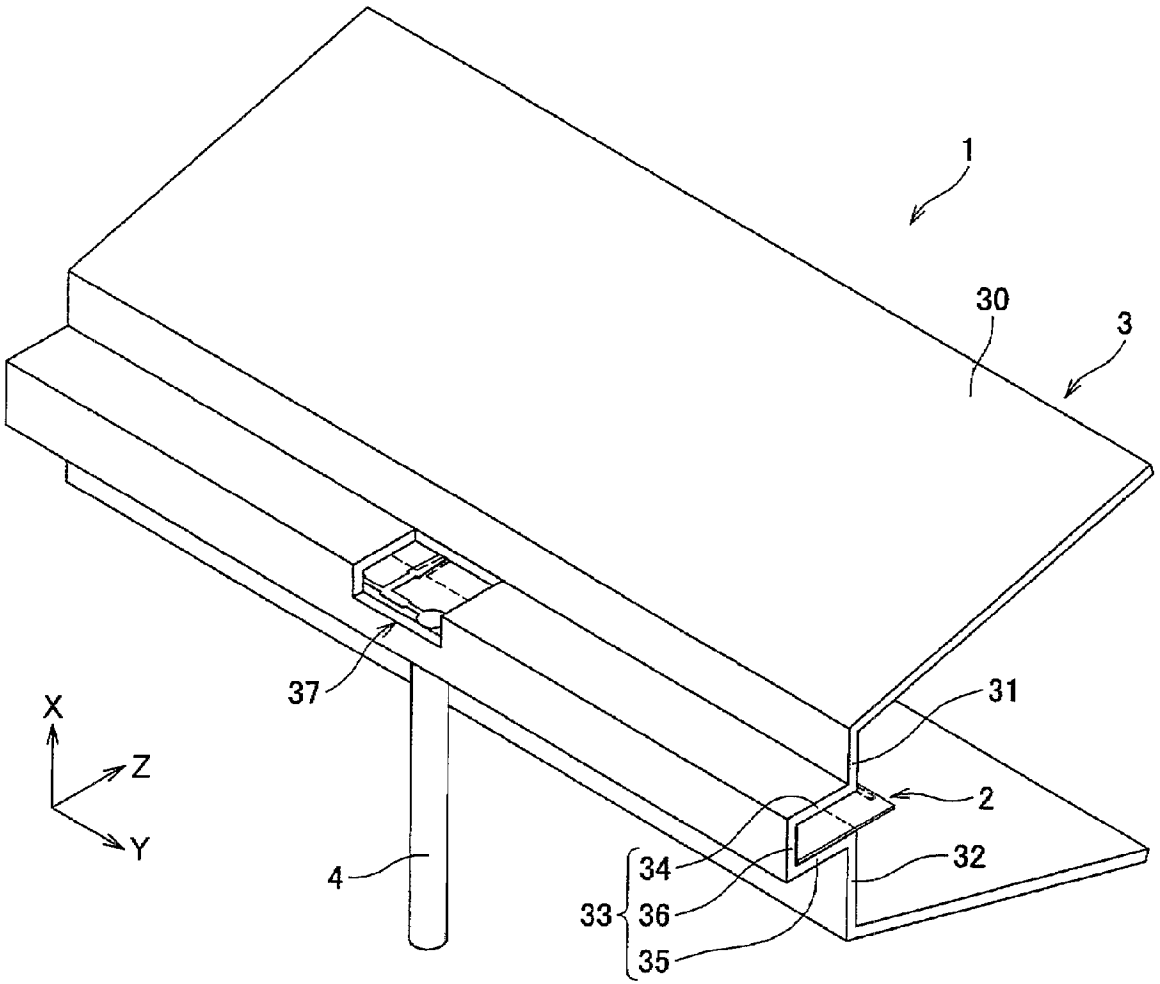
FIG. 6 is a perspective view of the antenna device.

As described above, the horn 3 includes the horn body 30, the two reflectors 31 and 32, and the shield portion 33. As shown in FIGS. 1 and 6, the horn 3 has a cross-sectional shape that is substantially uniform in the y-axis direction. The lengths in the y-axis direction are substantially the same for the horn body 30, the reflectors 31 and 32, and the shield portion 33. The horn 3 is made of, but not limited to, a metal material, such as copper or aluminum.

As shown in FIG. 4, the horn body 30 includes a pair of plate members arranged vertically symmetrical on the both sides of the antenna substrate 2. In this embodiment, the pair of plate members constituting the horn body 30 are arranged so as to spread open to the front (to the right in FIG. 4). The pair of plate members may be arranged in parallel to each other.

The two reflectors 31 and 32 are coupled to the base portion of the horn body 30, respectively. The two reflectors 31 and 32 are arranged vertically to each other and, thus, are arranged perpendicular to the z-axis direction.

The antenna substrate 2 intervenes between the two reflectors 31 and 32, and the reflectors 31 and 32 are located behind the dipole antenna 21 (see FIG. 1). A dimension "A" (see FIG. 4) between the dipole antenna 21 and the front face of the reflectors 31 and 32 in the z-axis direction may be set according to a wavelength of the electromagnetic waves radiated from the dipole antenna 21. The electromagnetic waves are radiated rearward from the dipole antenna 21, and then reflect on the reflectors 31 and 32. Therefore, the dimension "A" is set such that a phase of the electromagnetic waves is in agreement with a phase of the electromagnetic waves radiated forward from the dipole antenna 21.

The gap D is formed between a lower end portion of the reflector 31 and the upper surface of the antenna substrate 2, and an upper end portion of the reflector 32 is in contact with the lower surface of the antenna substrate 2. A length of the reflector 32 in the vertical direction may be set such that the antenna substrate 2 is located at the center of the horn body 30 in the vertical direction.

The shield portion 33 is formed between the two reflectors 31 and 32 so as to project rearward from the reflectors 31 and 32. In this embodiment, the shield portion 33 includes an upper plate (first plate portion) 34, a lower plate (second plate portion) 35, and a rear plate (third plate portion) 36.

A front end portion of the upper plate 34 is coupled to a lower end portion of the reflector 31, and a front end portion of the lower plate 35 is coupled to an upper end portion of the reflector 32. In other words, the upper plate 34 is coupled to the base portion of the horn body 30 via the reflector 31, and the lower plate 35 is coupled to the base portion of the horn body 30 via the reflector 32. The upper plate 34 and the lower plate 35 intersect perpendicularly to the x-axis, and are arranged opposite to each other via the antenna substrate 2.

The antenna substrate 2 is placed on the upper surface of the lower plate 35, and it is then fixed to the upper surface with screws, etc. More particularly, a portion where the ground body 24*a* of the antenna substrate 2 is formed may be placed on the lower plate 35, and a substantially front half part of the antenna substrate 2 may project toward the horn body 30. Thereby, the antenna substrate 2 can be fixed to the horn 3 stably. A through-hole (not illustrated) into which the feeder pipe 4 is inserted is formed in the lower plate 35.

In this embodiment, the upper plate 34 is arranged so as to oppose an area where the feeder line 23 of the antenna substrate 2 is formed. The gap D formed between the upper plate 34 and the antenna substrate 2 may preferably be 1/10 to 1/2 of the wavelength λ of the electromagnetic waves radiated from the dipole antenna 21, and more preferably 1/10 to 1/3 of the wavelength λ, for example.

The rear plate 36 intersects perpendicularly to the z-axis, and it is coupled to rear end portions of the upper plate 34 and the lower plate 35 so as to enclose the gap between the upper plate 34 and the lower plate 35 from the rear side.

As shown in FIG. 6, a notched portion 37 is formed in a center portion of the upper plate 34 and the rear plate 36 in the y-axis direction. A length of the notched portion 37 in the y-axis direction may preferably be less than the arranged intervals of the branch lines 23*b* in the y-axis direction. Because the notched portion 37 is formed, it may be easy to fix the antenna substrate 2 to the lower plate 35 with screws, etc. In this embodiment, only one notched portion 37 is formed in the center portion of the shield portion 33 in the y-axis. The number and formed position of the notched portion 37 may not be limited to this, and they may be selected arbitrary.

The feeder pipe 4 supplies electric power to the feeder line 23, and serves as a supporting post of the horn 3 as well. As shown in FIG. 4, the feeder pipe 4 extends vertically, and is inserted in the through-hole (not illustrated) formed in the lower plate 35. The feeder pipe 4 is coupled to the antenna substrate 2. The feeder pipe 4 includes a central conductor 4*a* (see FIG. 1), an air layer or dielectric layer (not illustrated) formed on the periphery of the central conductor 4*a*, and an outside conductor (not illustrated) further formed on the periphery of the dielectric layer. The central conductor 4*a* is connected to the feeder portion 23*c* so as to penetrate the dielectric substrate 20, and the outside conductor (not illustrated) is connected to the ground body 24*a*.

In this embodiment, the feeder pipe 4 penetrates the lower plate 35, and supplies electric power to the feeder line 23 from the lower surface of the antenna substrate 2. Alternatively, the feeder pipe may penetrate the rear plate 36 (or through the notched portion 37), and may supply electric power to the feeder line 23 from the upper surface of the antenna substrate 2. In this case, the through-hole (not illustrated) of the lower plate 35 will not be required.

Next, an operation of the antenna device 1 is explained.

After the electric power supplied via the feeder pipe 4 and the feeder portion 23*c* travels through the trunk line 23*a*, is branched into the eight branch lines 23*b*, and is then supplied to the dipole antenna 21. Thereby, each of the dipole antennas 21 is excited and an electromagnetic wave is radiated.

This is a case where the electric power is supplied from the feeder portion 23*c* and the electromagnetic waves are transmitted from each dipole antenna 21; however in the case of reception, the process will be in the opposite direction. That is, the electric power received by each dipole antenna 21 is transmitted to the feeder portion 23*c* via the feeder line 23.

As described above, the dipole antenna normally radiates the electromagnetic waves such that the radiated electric power in the arranged direction of the two antenna elements (in this embodiment, the plus direction and the minus direction in the y-axis) is zero and the radiated electric power to a direction perpendicular to the arranged direction of the two antenna elements is the maximum.

A part of the electromagnetic waves radiated from the dipole antennas 21 in the direction intersecting with the antenna substrate 2 is reflected on an inner face of the horn body 30, and then travels forward. Therefore, a beam width in the x-axis direction will be small and, thus, the electric power of the electromagnetic waves radiated from the dipole antennas 21 can be collected forward.

Because the reflectors 31 and 32 are arranged behind the dipole antennas 21, the electromagnetic waves radiated rearward from the dipole antennas 21 reflect on the reflectors 31 and 32, and then travel forward. Therefore, the electric power of the electromagnetic waves to be originally radiated rearward can be collected forward effectively.

In addition, because the eight dipole antennas 21 are parallely arranged in the y-axis direction, the respective electromagnetic waves radiated from the eight dipole antennas 21 are synthesized to reduce the beam width in the y-axis direction. As a result, the electric power of the electromagnetic waves radiated from the dipole antennas 21 can be collected forward effectively.

As described above, the direction of the electromagnetic waves radiated from antenna device 1 (primary beam direction) will only be the forward direction (z-axis direction).

In this case, because the feeder line 23 that supplies the electric power to the dipole antennas 21 is formed on the dielectric substrate 20, electromagnetic waves produced by current flowing through the feeder line 23 (disused radiation) is radiated in a direction perpendicular to the dielectric substrate 20 (x-axis direction). The disused radiations may easily be produced particularly at the branched locations of the feeder line 23 (coupling points of the trunk line 23*a* and the branch lines 23*b*), or at locations where their width vary.

Because the dielectric substrate 20 is arranged in parallel with the z-axis direction, the direction of the primary beam radiated from the dipole antenna substrate 2 (z-axis direction) and the direction of the disused radiations radiated from the feeder line 23 are perpendicular to each other. Therefore, the antenna device 1 can radiate the electromagnetic waves of substantially designed characteristics, without the electromagnetic waves radiated from the dipole antennas 21 receiving substantially no influences of the disused radiations.

As described above, the upper plate 34 and the lower plate 35 is arranged oppositely to each other via the area where the feeder line 23 of the antenna substrate 2 is formed. For this reason, the disused radiations radiated from the feeder line 23 are enclosed in a space between the upper plate 34 and the lower plate 35, and thereby suppressing the disused radiations being leaked to the outside. The disused radiations radiated from the feeder line 23 create an electromagnetic field between the upper plate 34 and the lower plates 35. Electromagnetic waves caused by the electromagnetic field may be leaked to the side of the horn body 30. However, the electromagnetic waves do not have a specific directivity and, thus, they are leaked in various directions only gradually. Therefore, the electromagnetic waves radiated forward from the dipole antennas 21 are hardly affected.

Because between the rear end portions of the upper plate 34 and the lower plate 35 are closed with the rear plate 36, it can certainly prevent that the disused radiations from the feeder line 23 are leaked rearward. In addition, is the case where the electromagnetic waves radiated rearward from the dipole antennas 21 enter between the upper plate 34 and the antenna substrate 2, it can prevent that the electromagnetic waves are leaked rearward by passing through the space between the upper plate 34 and the antenna substrates 2.

Because the notched portion 37 is formed in the shield portion 33 in this embodiment, one may think that the disused radiations inside the shield portion 33 radiate to the outside through the notched portion 37. However, as apparent from the results of simulations (described later), if the length of the notched portion 37 in the y-axis direction is substantially below the intervals of the branch lines 23*b*, the disused radiations are hardly leaked to the outside from the notched portion 37. Therefore, the rear plate 36 can still prevent the disused radiations from being radiated to the outside.

If the electric power supplied is very large, because the electric power of the disused radiations particularly near the feeder portion 23*c* will also be large, the disused radiations may be leaked to the outside from the notched portion 37. Thereby, the electromagnetic field near the feeder portion 23*c* inside the shield portion 33 will be weaker. As a result, the electromagnetic field of the disused radiations can prevent the disturbance of the electromagnetic waves radiated forward from the dipole antennas 21.

If the gap D between the upper plate 34 and the antenna substrate 2 is excessively smaller than 1/10 of the wavelength λ, the electromagnetic field between the upper plate 34 and the antenna substrate 2 will be stronger; and due to this electromagnetic field, it will be impossible to supply a desired electric power to the dipole antennas 21. Thus, by having the gap between the upper plate 34 and the antenna substrate 2 of 1/10 of the wavelength λ or greater, a desired electric power can be supplied to the dipole antenna 21, which may be impossible due to the electromagnetic field produced between the upper plate 34 and the antenna substrate 2.

If the gap D between the upper plate 34 and the antenna substrate 2 (i.e., the gap D between the lower end portion of the reflector 31 and the antenna substrate 2) is excessively larger than 1/2 of the wavelength λ, the electromagnetic waves reflected on the reflector 31 will be reduced considerably compared with the electromagnetic waves reflected on the reflector 32. As a result, the vertical symmetry of the directivity of the electromagnetic waves radiated forward will collapse. Therefore, by having the gap D between the reflector 31 and the antenna substrate 2 of 1/2 of the wavelength λ or less, the vertical asymmetric level of the directivity of the electromagnetic waves radiated forward can be suppressed within a permissible range.

In addition, if the gap D between the upper plate 34 and the antenna substrate 2 is larger than 1/3 of the wavelength λ, the electromagnetic waves radiated rearward from the dipole antennas 21 may easily enter between the upper plate 34 and the antenna substrate 2. The electromagnetic waves entered between the upper plate 34 and the antenna substrate 2 will be reflected on the rear plate 36 and then travels forward.

In this case, depending on a dimension B in the z-axis direction between the dipole antennas 21 and the front surface of the rear plate 36 (see FIG. 4), the electromagnetic waves reflected on the rear plate 36 may have a bad influence on the characteristics of the electromagnetic waves radiated forward from the dipole antennas 21. Therefore, the dimension B may preferably be set according to the wavelength λ. More specifically, the electromagnetic waves radiated rearward from the dipole antennas 21 pass through between the upper plate 34 and the antenna substrates 2, and then reflect on the rear plate 36 to be discharged forward. Thus, the dimension B may be set such that the phase of the electromagnetic waves is in agreement with the phase of the electromagnetic waves radiated forward from the dipole antenna 21.

On the other hand, if the gap D between the upper plate 34 and the antenna substrate 2 is set to ⅓ of the wavelength λ or less of the electromagnetic waves, because the electromagnetic waves radiated rearward from the dipole antennas 21 will be difficult to enter between the upper plate 34 and the antenna substrate 2, the dimension B can be set without depending on the wavelength λ. Therefore, even if the wavelength λ of the electromagnetic waves is changed, the same horn 3 can still be used.

Particularly, when the electric power supplied is quite large and the gap D is small, a voltage difference between the feeder line 23 and the upper plate 34 or the lower end portion of the reflector 31 will be large if the feeder line 23 is not covered with an insulator. For this reason, there is a case where an electric discharge may occur between these components and the electric power cannot be supplied to the dipole antenna. When such an electric discharge may occur, it may be preferred to cover the feeder line 23 with the insulator. Thereby, it can suppress the electric discharge occurring between the feeder line 23 and the upper plate 34, etc.

Typically, the direction of an electric field component of electromagnetic waves radiated from an antenna is in agreement with the direction in which current flowing through the antenna. Because the direction of current flowing through the dipole antennas 21 is mainly in the y-axis direction, the electromagnetic waves radiated from the dipole antennas 21 will mainly contain so-called "horizontal polarized waves" whose direction of electric field component is parallel to the ground surface. The electromagnetic waves whose direction of the electric field component is perpendicular to the ground surface (x-axis direction) are referred to as "vertical polarized waves." Normally, the horizontal polarized waves are utilized for ship radars. In order to improve the transmission efficiency of electric power, it may be preferred that a ratio of the electric power of cross polarized waves (polarized waves perpendicular to primary polarized waves) with respect to the electric power of the primary polarized wave radiated from the antenna is suppressed (cross-polarization ratio).

Note that, in the patch antenna device disclosed in JP1993-206729(A) described above, similar to this embodiment, when electromagnetic waves are radiated in a predetermined direction parallel to the ground surface (corresponding to the z-axis direction in FIG. 1), the dielectric substrate of this disclosure is arranged perpendicularly to the ground surface. Because the patch has a structure of a rectangular shape, current flows in the horizontal, vertical, and oblique directions, when electromagnetic waves are radiated. Although the electromagnetic waves radiated from the patch have their primary component in the horizontal direction, they also have components in the vertical or oblique direction. Therefore, the cross-polarization ratio of the electromagnetic waves radiated from the patch will be degraded. On the other hand, in this embodiment, each dipole antenna 21 is formed with in-line antenna elements. Therefore, it hardly generates the disused components in the vertical or oblique direction during the electromagnetic wave radiation and, thus, the cross-polarization ratio can be suppressed.

In the antenna device 1 described above, the dipole antennas 21 and the traces 22 (and the feeder line 23 and the ground 24 as well) are printed on the dielectric substrate 20. For this reason, the dipole antennas 21 and the traces 22 can be formed in a single process. Compared with the case where the dipole antennas 21 or the traces 22 may be constructed with a bar-shaped conductor, manufacturing of the device will be easier and its cost can be reduced. Attaching to the horn 3 will also be easy by the arrangement of both of the dipole antennas 21 and the traces 22 on a single antenna substrate 2.

In this embodiment, although the both ends of the shield portion 33 in the y-axis direction is open, they may be closed by metal plate members. Thereby, it can prevent more certainly that the disused radiations radiated from the feeder line 23 are leaked to the outside. Similarly, the both ends of the horn body 30 in the y-axis direction may be closed by metal plate members. Therefore, it can suppress that the electromagnetic waves radiated from the dipole antennas 21 are radiated to the outside in directions other than the front.

In this embodiment, although the antenna substrate 2 is fixed to the horn 3 so that it is placed on the lower plate 35, the configuration for fixing the antenna substrate 2 may not be limited to this. For example, a rear end portion of the antenna substrate 2 may be fixed to the rear plate 36. In this case, a gap may be formed between the lower plate 35 and the antenna substrate 2. Further, vertical lengths of the reflectors 31 and 32 may be made identical, and the antenna substrate 2 may be arranged in a center portion of the shield portion 33 in the vertical direction. In this case, the electromagnetic waves which are radiated rearward from the dipole antenna 21 and reflected on the reflector 31, and the electromagnetic waves which are radiated rearward from the dipole antenna 21 and reflected on the reflector 32 will be substantially identical. Thereby, the directivity of the electromagnetic waves radiated forward will be substantially symmetrical in the vertical direction.

Second Embodiment

Next, a second embodiment of the present invention is explained. Components having similar configurations to the first embodiment are denoted with like numerals to suitably omit the explanations.

Figure 7:
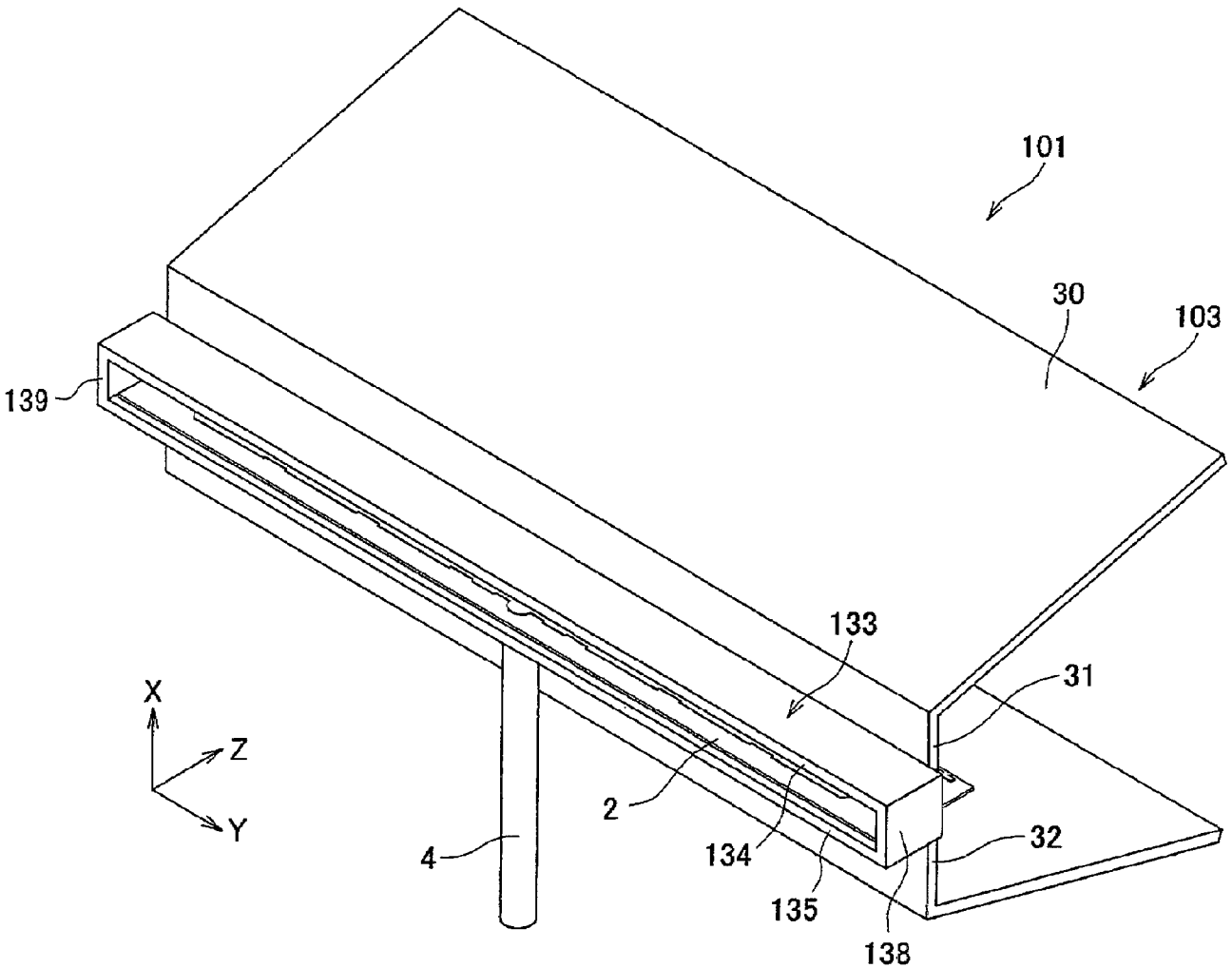
FIG. 7 is a perspective view of an antenna device according to a second embodiment of the present invention.

Although an antenna device 101 of this embodiment differs in the configuration of the shield portion from the first embodiment, configurations of other components are similar to that of the first embodiment. As shown in FIG. 7, the shield portion 133 of this embodiment includes an upper plate 134, a lower plate 135, and two side plates 138 and 139. The side plate 138 couples plus-side end portions of the upper plate 134 and the lower plate 135 in the y-axis. The side plate 139 couples minus-side end portions of the upper plate 134 and the lower plate 135 in the y-axis.

Preferably, the gap D between the upper plate 134 and the antenna substrate 2 may be 1/10 to ⅓ of the wavelength λ of the electromagnetic waves, for example. The dimension of the upper plate 134 in the z-axis direction will not be limited in particular as long as it has a dimension such that the upper plate 34 is arranged so as to oppose to the area where the feeder line 23 of the dielectric substrate 20 is formed.

According to the antenna device 101 of this configuration, similar to the first embodiment, the disused radiations radiated from the feeder line 23 are enclosed between the upper plate 134 and the lower plate 135 and, thus, the disused radiations are suppressed to be leaked to the outside. If the gap D between the upper plate 134 and the antenna substrate 2 is ⅓ or less of the wavelength λ of the electromagnetic waves, the electromagnetic waves radiated rearward from the dipole antennas 21 hardly enter the space between the upper plate 134 and the antenna substrate 2. Therefore, it can be supressed that the electromagnetic waves are radiated to the outside from the rear end of the shield portion 133.

If the rear plate 36 similar to the first embodiment is provided, it may be necessary to set the dimension of the dielectric substrate 20 in the z-axis direction shorter than the dimension B that is from the dipole antennas 21 to the rear plate 36. In contrast to this, because the rear plate is not provided in this embodiment, the dimension of the dielectric substrate 20 in the z-axis direction is not restricted. In this embodiment, the upper plate 134 and the lower plate 135 are coupled by the two side plates 138 and 139. The configuration in which the upper plate 134 and the lower plate 135 are coupled without providing the rear plate 36 is not limited to this. For example, the rear end portions of the upper plate 134 and the lower plate 135 may be coupled by a plate member in which many slits are formed. Alternatively, for example, the upper plate 134 and the lower plate 135 may be coupled by a plurality of supports arranged in the y-axis direction, which may be provided between the rear end portions of the upper plate 134 and the lower plate 135.

Thus, if providing the coupling member in the rear end portions of the upper plate 134 and the lower plate 135, a distance between the coupling member and the dipole antennas in the z-axis direction may preferably be longer as possible. This makes easier to select the dimension of the dielectric substrate 20 in the z-axis direction.

Although the first and second embodiments are described as preferable embodiments of the present invention, the embodiments may be modified as follows.

Modified Embodiment 1

In the first and second embodiments, although the two antenna elements 21*a* and 21*b* that constitute each dipole antenna 21 are formed on the upper surface and the lower surface of the dielectric substrate 20, respectively, they may be formed on the same surface of the substrate 20.

Modified Embodiment 2

In the first and second embodiments, although the feeder line 23 is formed on the dielectric substrate 20, the feeder line 23 may be formed inside the dielectric substrate 20. In other words, for example, the dielectric substrate 20 may have a multilayer structure, and the feeder line 23 may be formed between the layers.

Modified Embodiment 3

In the first and second embodiments, although the microstrip lines are used as the traces 22, the type of the traces 22 is not limited to this. For example, a coplanar trace in which a ground and a feeder line are formed on the same surface of a dielectric substrate may also be use as the traces. Note that, even if the transmission lines other than the microstrip lines are used for the traces 22, the disused radiations may be radiated from the feeder line in the direction perpendicular to the dielectric substrate 20.

Modified Embodiment 4

The horn 3 may not be provided with the shield portion 33 (or 133). In this case, a fixture (e.g., corresponding to the lower plate 35) for fixing the antenna substrate 2 to the deeper side of the horn 3 may be needed. If the shield portion 33 (or 133) is not provided, the disused radiations radiated from the feeder line 23 are radiated to the outside. However, it may be able to obtain an effect in which the electromagnetic waves radiated forward from the dipole antenna 21 are hardly influenced by the disused radiations.

Modified Embodiment 5

In the first and second embodiments, although the feeder pipe 4 also serves as the supporting post of the horn 3, the horn 3 may be directly attached to a fixture stand, etc.

Simulation Results

In the configuration of the first embodiment, the result of the simulation at the time of changing the size of the gap D between the upper plate 34 and the antenna substrate 2 is shown.

FIGS. 8A and 8B, and 9A and 9B show radiation characteristics when the gap D is ¼ and ½ of the wavelength λ, respectively. FIGS. 10A and 10B, 11A and 11B, and 12A and 12B show radiation characteristics when the gap D is 1/10, 1/16, and 1/32 of the wavelength λ, respectively.

In FIGS. 8A to 12A show the directivities in the y-z plane, and FIGS. 8B to 12B show the directivities in the x-z plane. In these characteristic diagrams, a black line shows the directivity of the horizontal polarized wave (primary polarized wave) component, and a gray line shows the directivity of the vertical polarized wave (cross polarized wave) component. Further, in FIGS. 8A to 12A and 8B to 12B, the plus direction of the z-axis is set to 0° direction with respect to the position of the dipole antennas 21 as a reference position. Further, in FIGS. 8A to 12A, 90° direction shows the plus direction of the y-axis. Further, in FIGS. 8B to 12B, 90° direction shows the plus direction of the x-axis. The radial axes show a relative gain (unit: dB) with respect to the maximum value. The same things are applied to FIGS. 13A and 13B, 14A and 14B, 15A and 15B, and 16A and 16B (described later).

In the simulation, the number of the dipole antennas 21 is 20 and, all are parallely arranged in the y-axis direction. The dielectric substrate 20 has a dielectric constant of 2.6, plate thickness of 0.74 mm, and length in the y-axis direction of 430 mm. The horn 3 has a dimension in the x-axis direction (height) of 86.06 mm, dimension in the z-axis direction (length) of 81.68 mm, and dimension in the y-axis direction (width) of 430 mm. An opening angle of the horn body 30 is set such that the vertical beam width becomes about 25°. The dimension B in the z-axis direction between the dipole antenna 21 and the front surface of the rear plate 36 is 27 mm. The notched portion 37 is not formed.

Figure 8A:
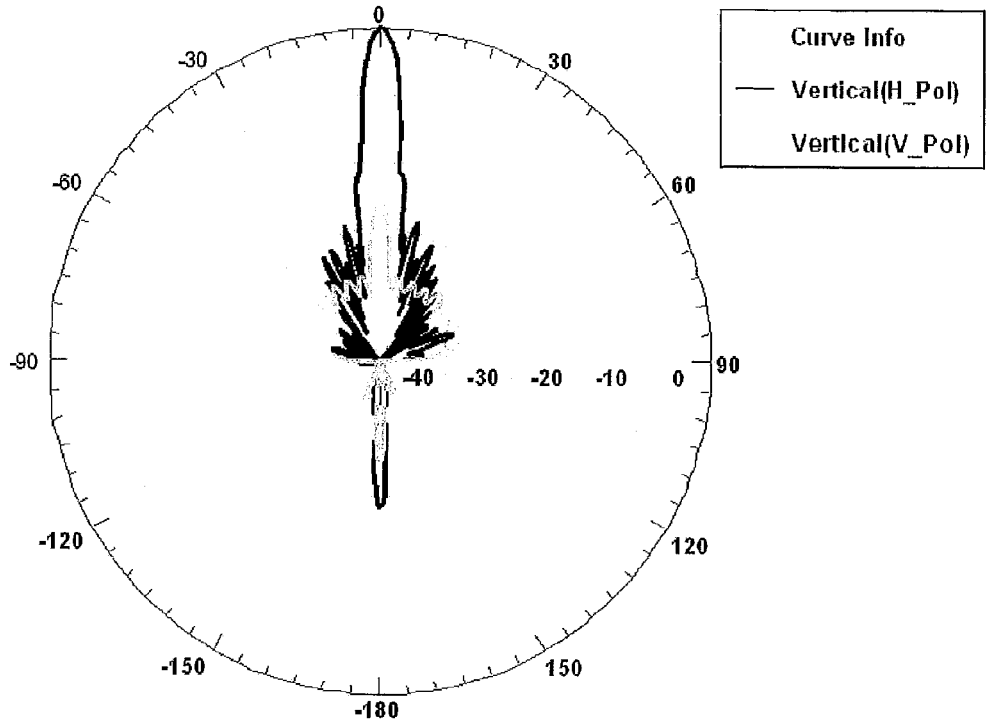
FIGS. 8A and 8B are graphs showing directivities of the antenna device of the embodiments.
Figure 8B:
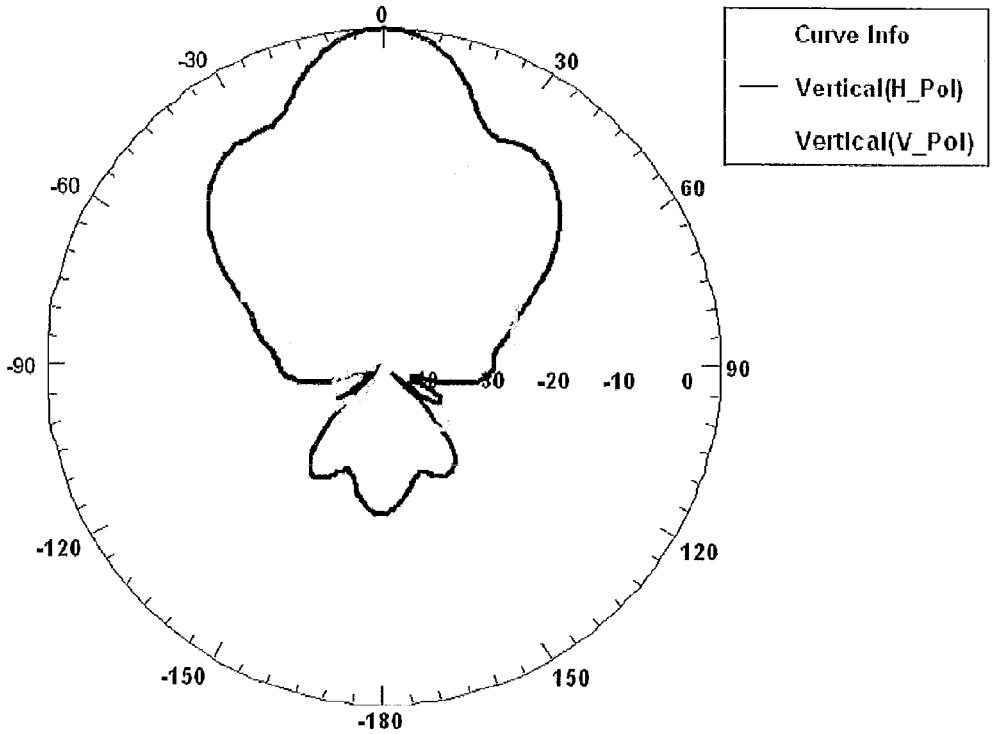
Figure 9A:
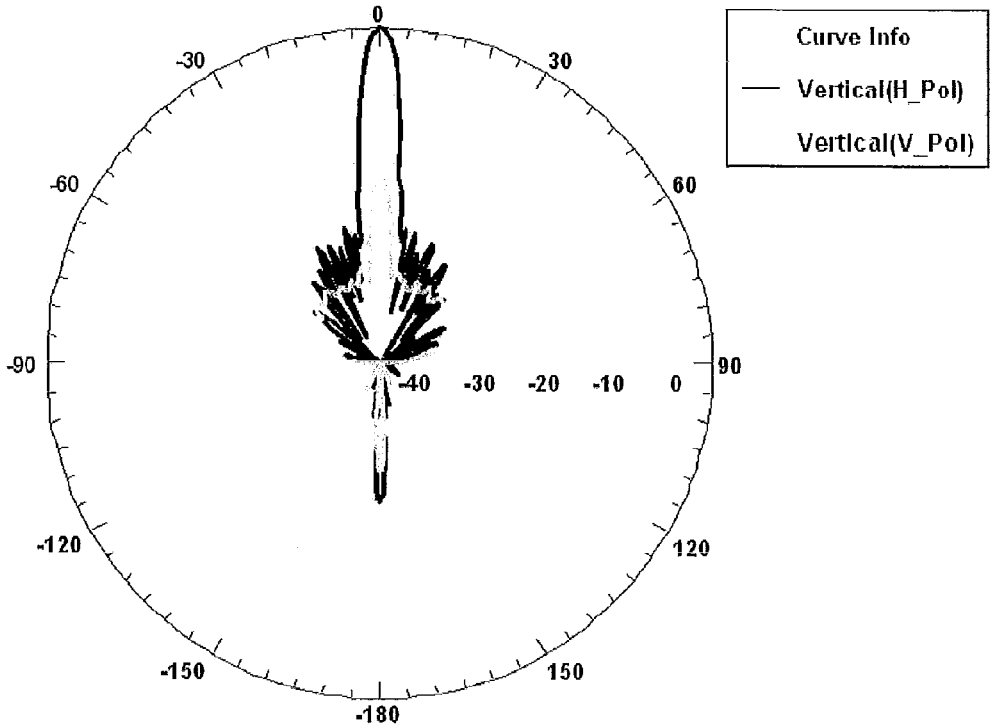
FIGS. 9A and 9B are graphs showing directivities of the antenna device of the embodiments.
Figure 9B:
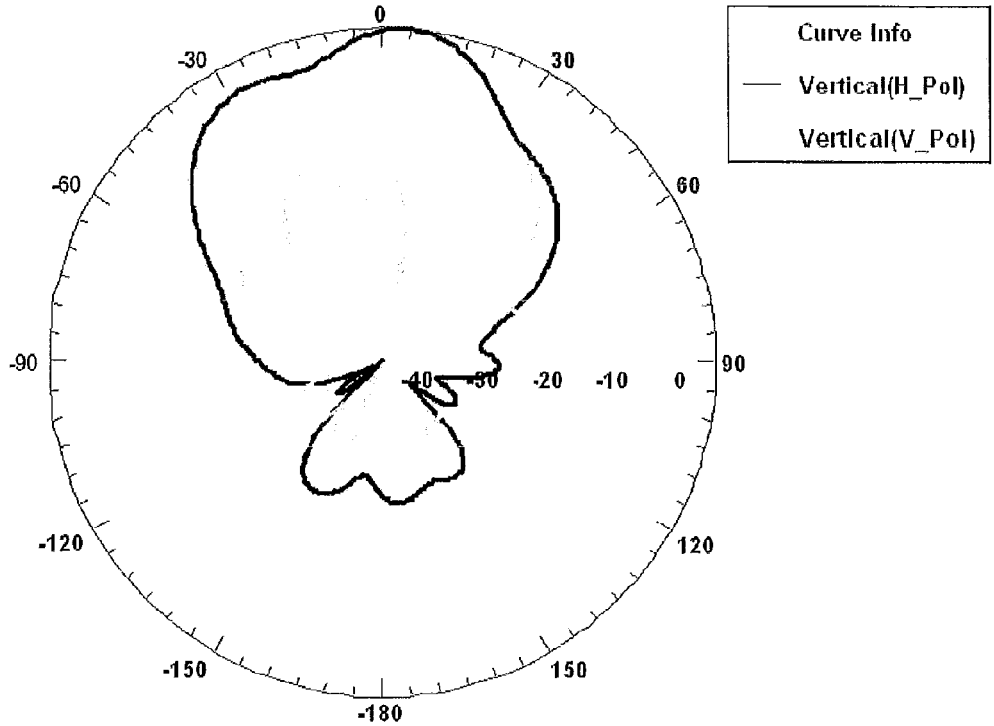

FIGS. 8A and 8B, and 9A and 9B show the results of the simulation in the conditions described above. As shown in the diagrams, for both of the cases where the gap D is λ/2 and λ/4, the rearward radiations are little, and the great portion of electric power radiated is concentrated forward. As shown in FIGS. 9A and 9B, when the gap D is λ/2, the symmetry of the directivity in the x-z plane is slightly collapsed. This can be considered that the electromagnetic waves reflected on the reflector 31 will decrease compared with the electromagnetic waves reflected on the reflector 32 as the gap D becomes greater. Therefore, the gap D is preferably λ/2 or less in the configuration of the first embodiment.

Figure 10A:
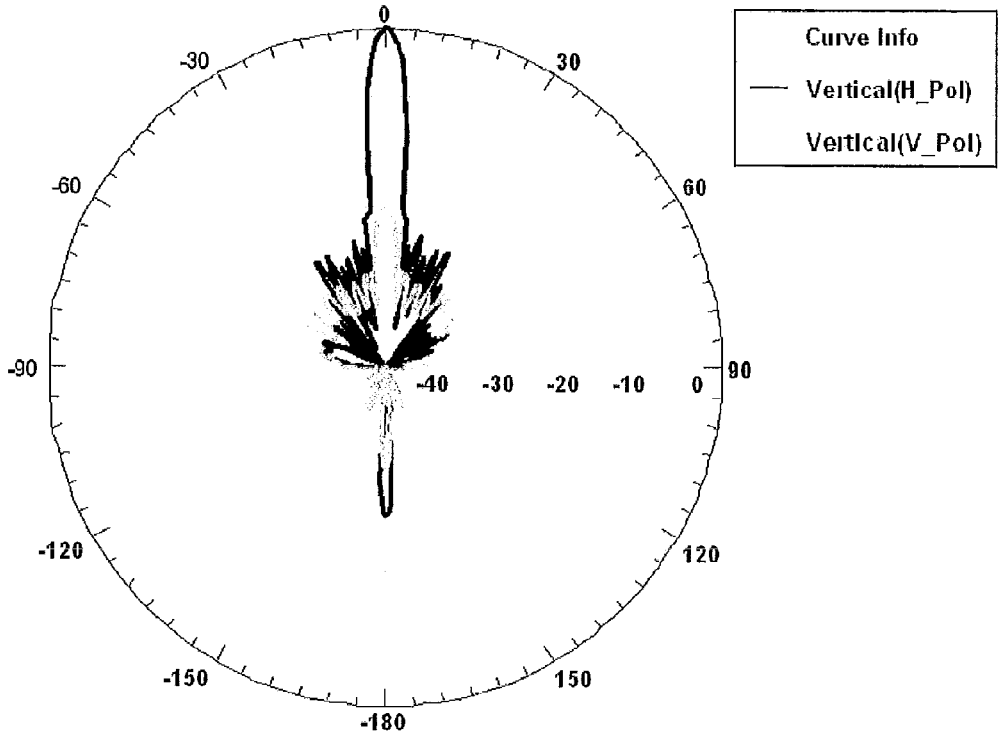
FIGS. 10A and 10B are graphs showing directivities of the antenna device of the embodiments.
Figure 10B:
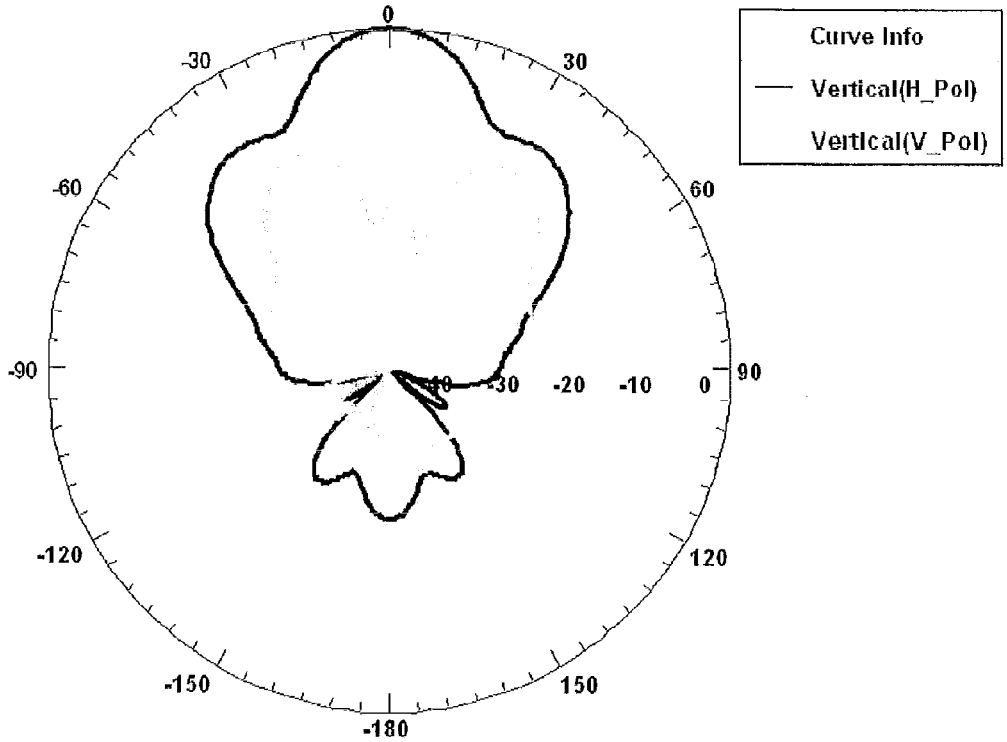
Figure 11A:
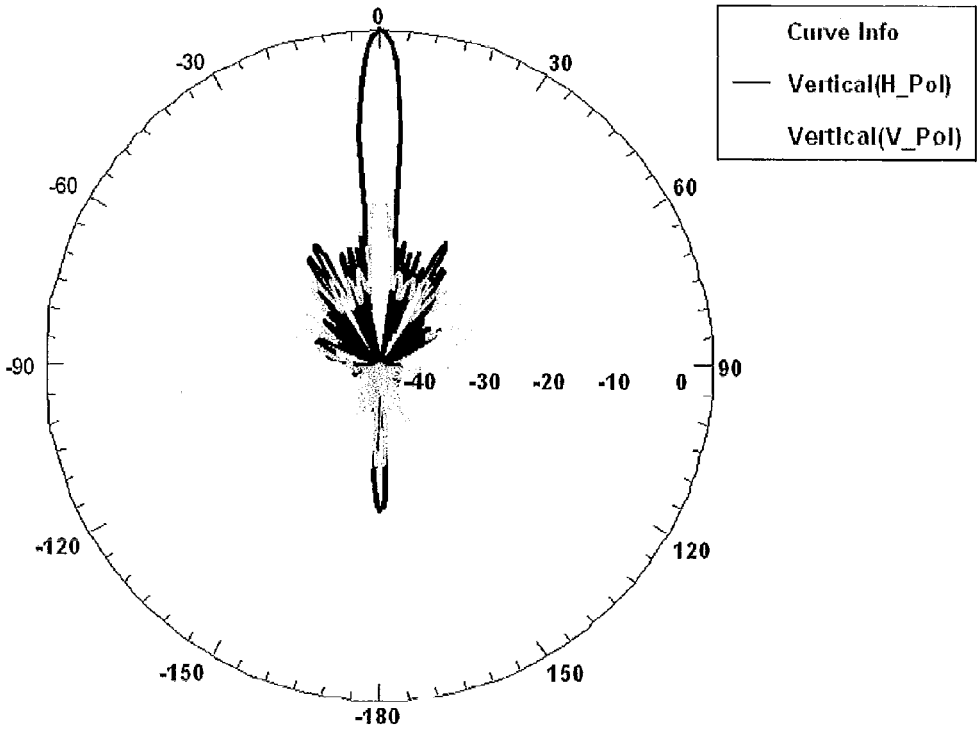
FIGS. 11A and 11B are graphs showing directivities of the antenna device of the embodiments.
Figure 11B:
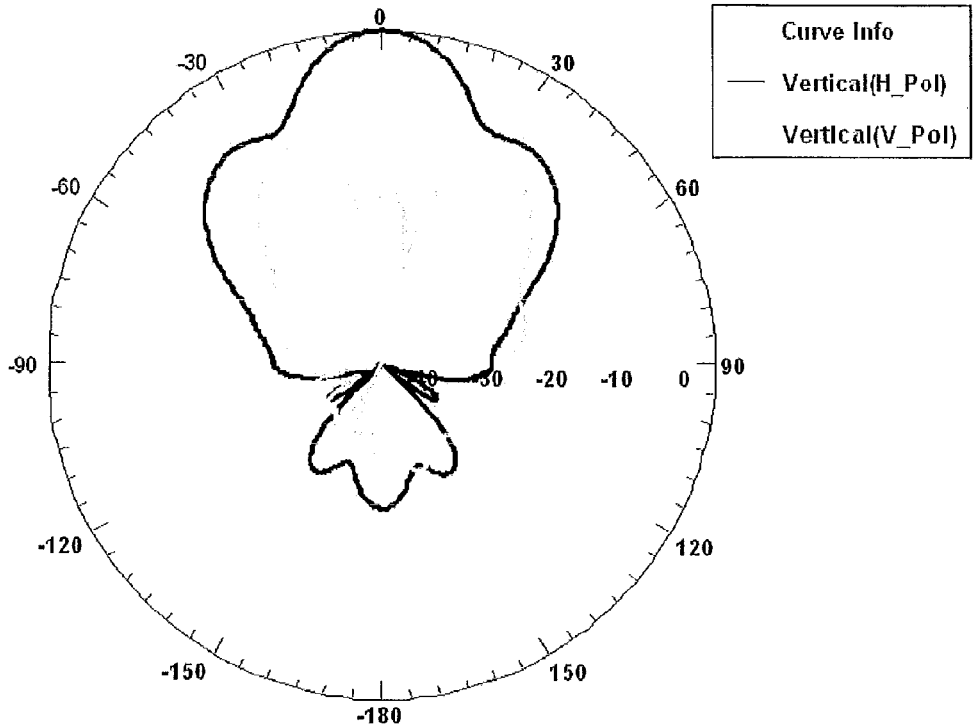
Figure 12A:
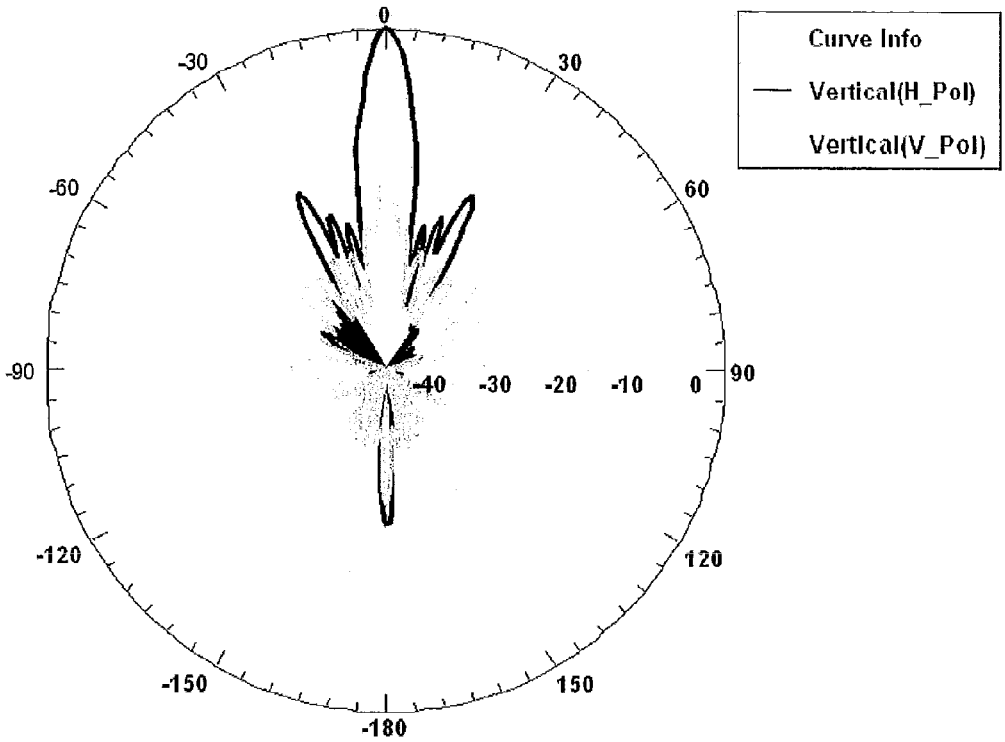
FIGS. 12A and 12B are graphs showing directivities of the antenna device of the embodiments.
Figure 12B:
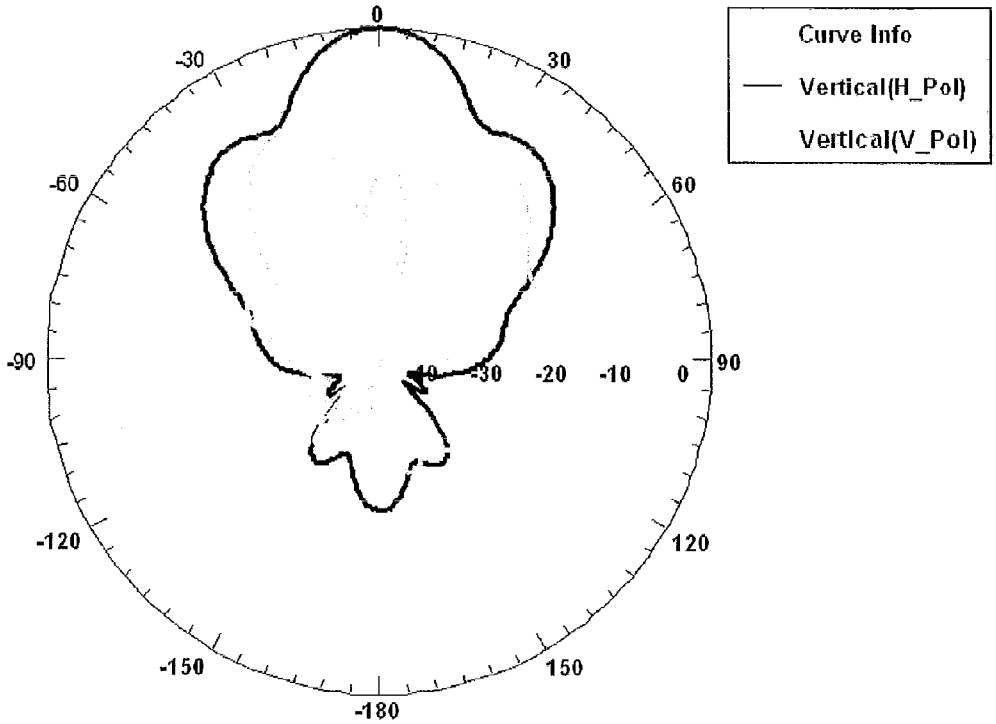
Figure 13A:
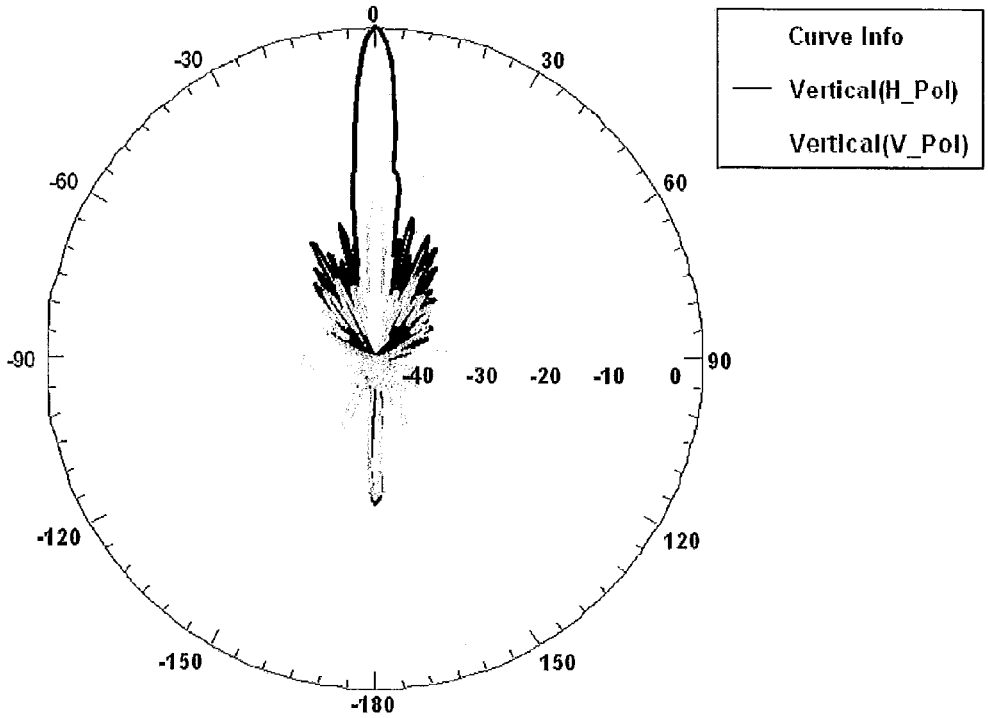
FIGS. 13A and 13B are graphs showing directivities of the antenna device of the embodiments.
Figure 13B:
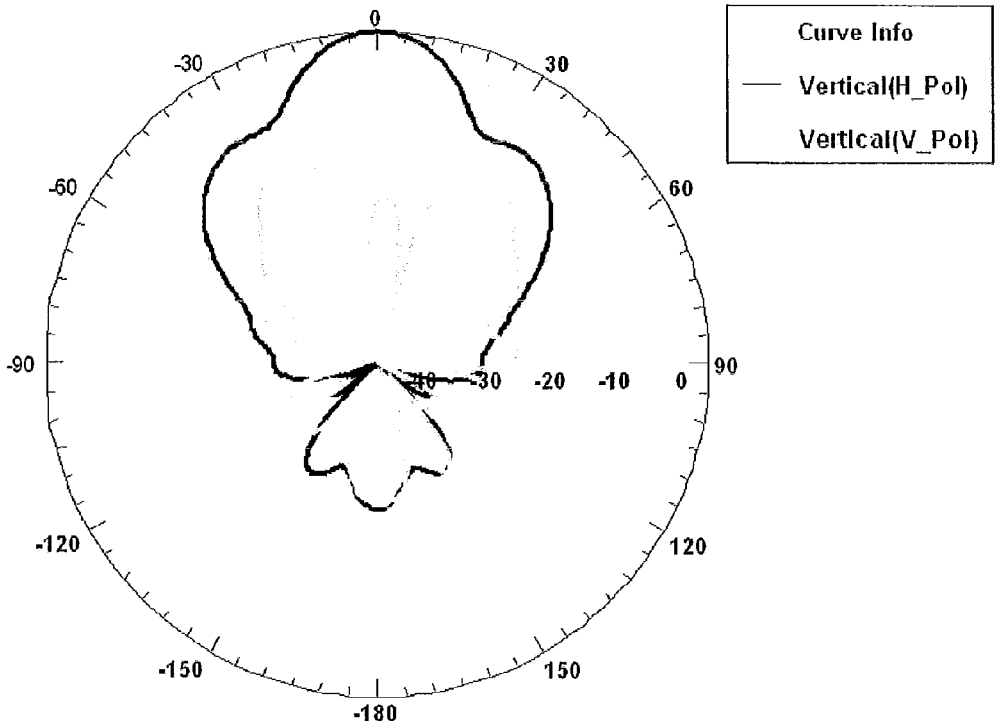
Figure 14A:
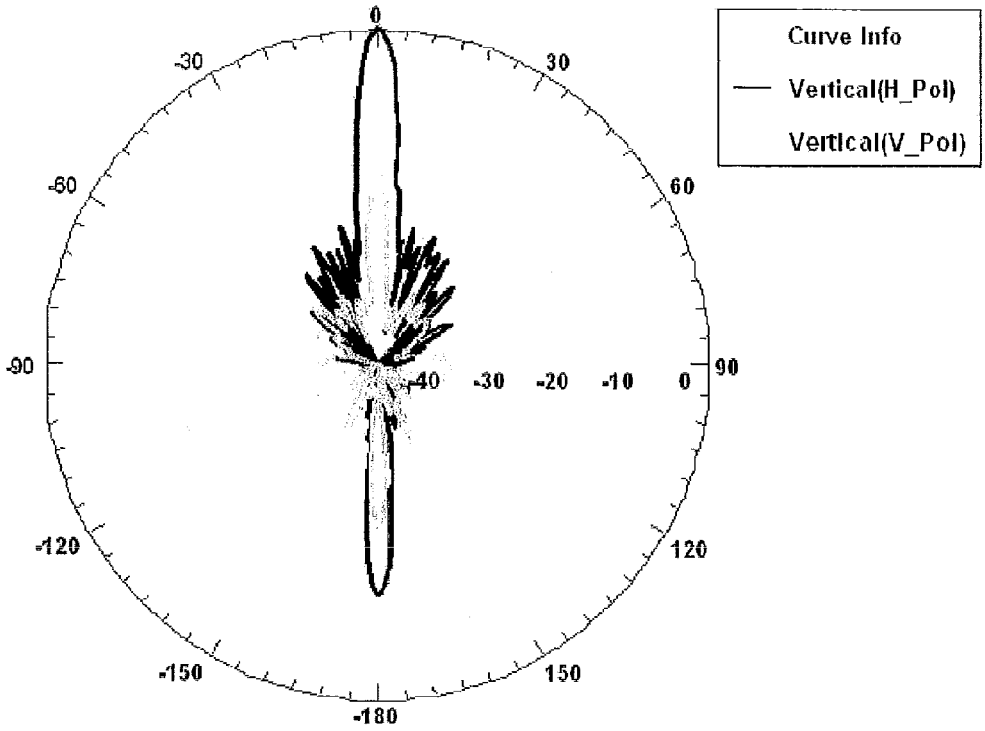
FIGS. 14A and 14B are graphs showing directivities of the antenna device of the embodiments.
Figure 14B:
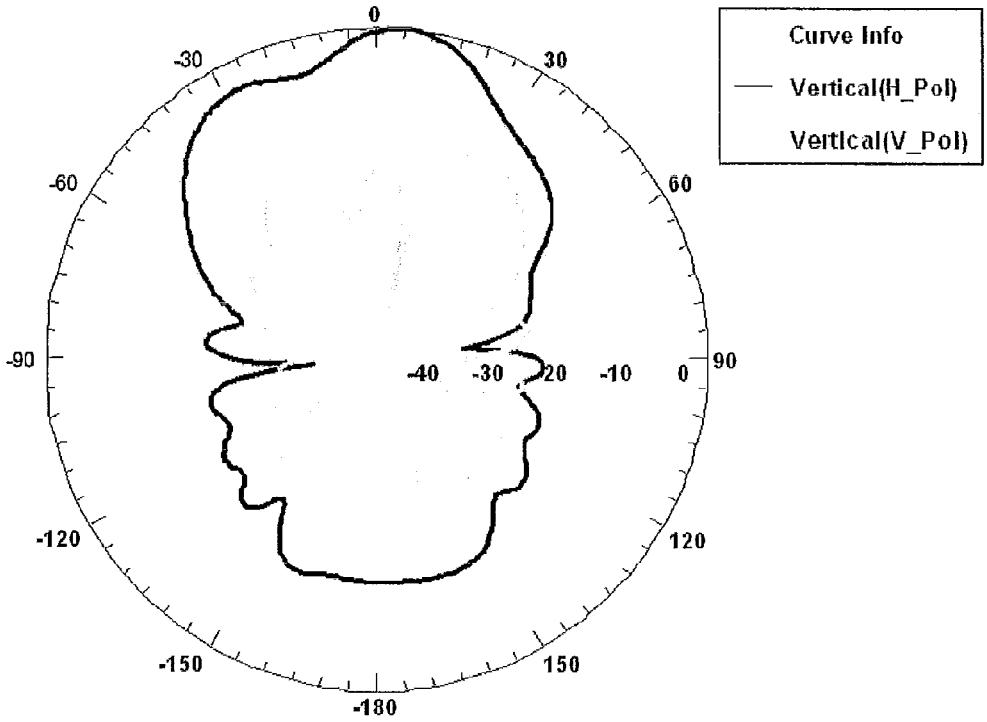

Now, as shown in FIGS. 10A and 10B, when the gap D is λ/10, the directivity is substantially the same as the directivity of λ/4 (refer to FIGS. 8A and 8B). As shown in FIGS. 11A and 11B, when the gap D is λ/16, side lobes (disused radiations generated in the directions different from the primary beam direction) are increased in the directivity range of −90° to +90° in the y-z plane. Because the gap D is too small in this case, an electromagnetic field between the upper plate 34 and the lower plate 35 will be stronger. Thus, a desired electric power cannot be supplied to the dipole antenna 21. Therefore, the gap D may preferably be λ/10 or greater in the configuration of the first embodiment.

For the case where the rear plate 36 is not provided to the shield portion 33 (configuration of the second embodiment), the simulation results will be explained as the size of the gap D is varied.

FIGS. 13A and 13B, and 14A and 14B show radiation characteristics when the gap D is ¼ and ½ of the wavelength λ, respectively. The conditions of the simulation are the same as the simulation conditions described above except that the rear plate 36 is not provided.

The results shown in FIGS. 8A and 8B, and 13A and 13B show that, when the gap D is λ/4, the directivity hardly changes even if the rear plate 36 is not provided. In more detail, when the rear plate 36 is not provided, although the cross polarized waves toward the rear (in x-z plane and y-z plane) slightly increase, the primary polarized wave hardly changes.

The results shown in FIGS. 9A and 9B, and 14A and 14B show that, when the gap D is λ/2, the electromagnetic waves radiated rearward increase if the rear plate 36 is not provided.

From the above results, the electromagnetic waves radiated rearward from the dipole antennas 21 may easily enter into the shield portion when the gap D is large, Therefore, it can be understood that the electromagnetic waves may be radiated rearward from the rear end of the shield portion if the rear plate 36 is not provided.

On the contrary, when the gap D is small, because the electromagnetic waves radiated from the dipole antenna 21 hardly enter the shield portion, the electromagnetic waves will be difficult to be radiated to the outside from the rear end of the shield portion even if the rear plate 36 is not provided.

Although simulation results are omitted, the directivity hardly changes even if the gap D is λ/3 and even if the rear plate 36 is not provided. Therefore, in order to prevent the electromagnetic waves from radiating rearward, the gap D may preferably be λ/3 or less when the rear plate 36 is not provided.

Next, the simulation results for the case where the notched portion 37 is formed in the shield portion 33 and for the case where the upper plate 34 is not provided are described.

Figure 15A:
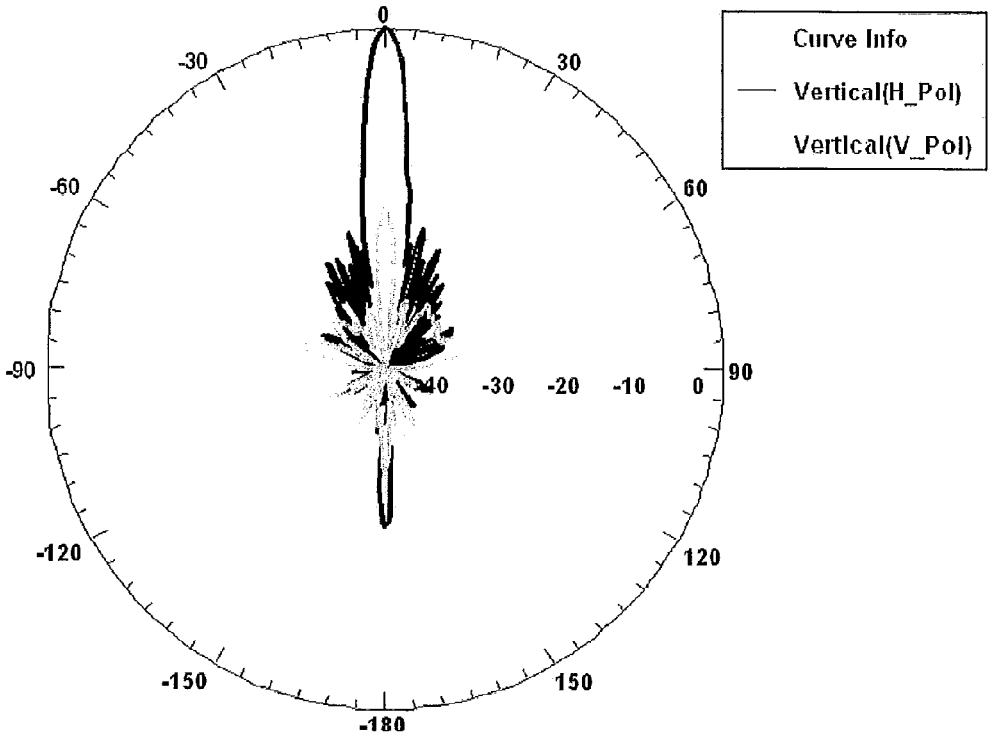
FIGS. 15A and 15B are graphs showing directivities of the antenna device of the embodiments.
Figure 15B:
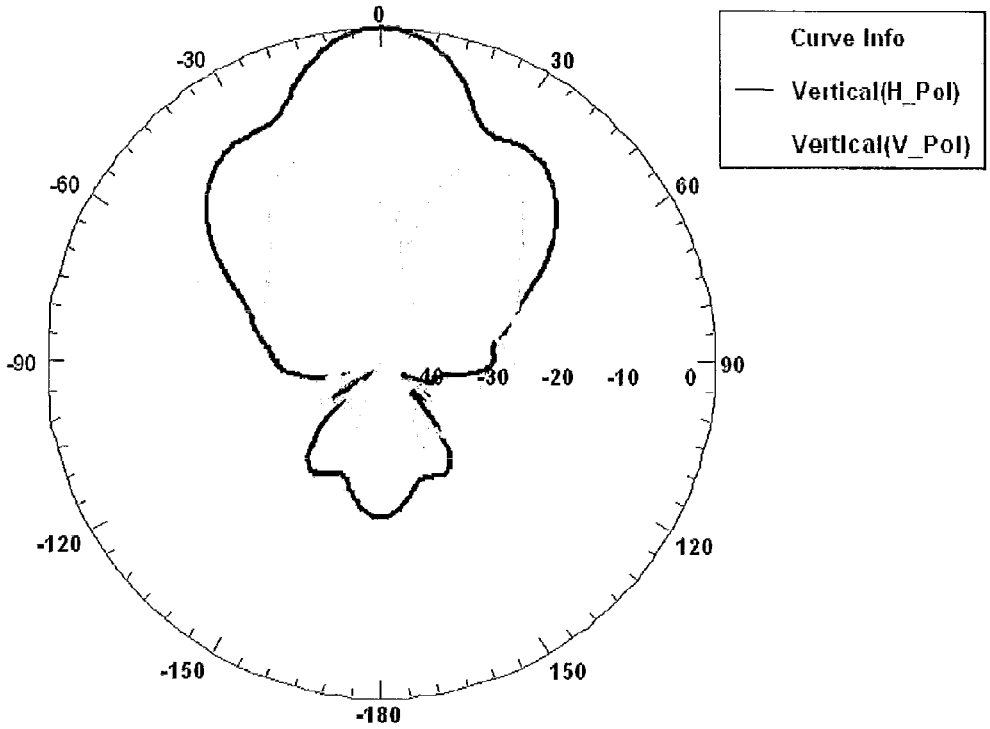
Figure 16A:
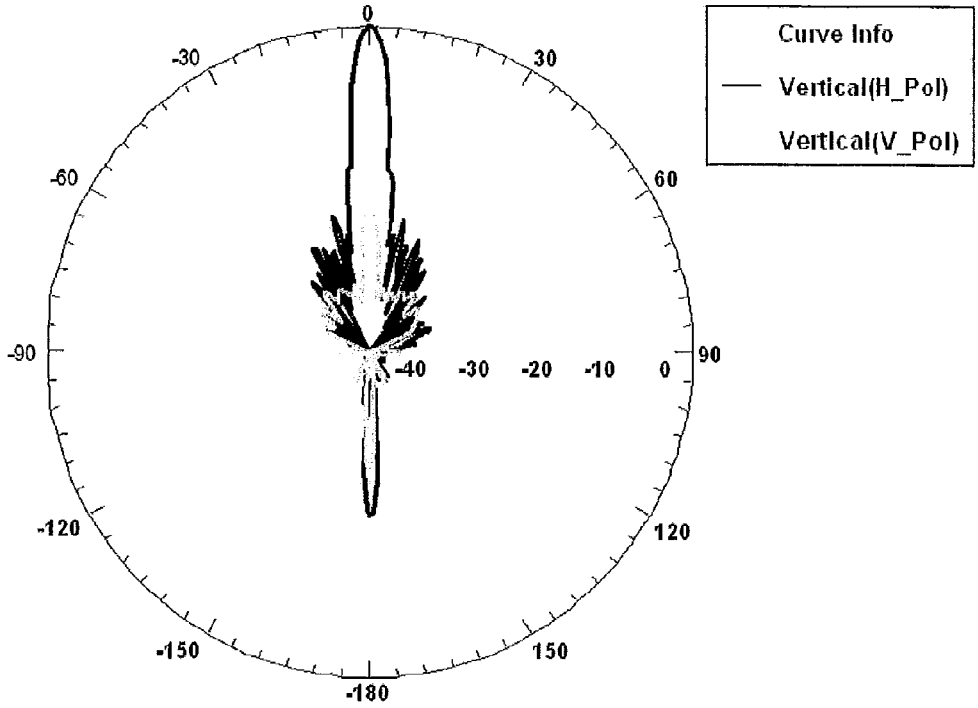
FIGS. 16A and 16B are graphs showing directivities of the antenna device of the embodiments.
Figure 16B:
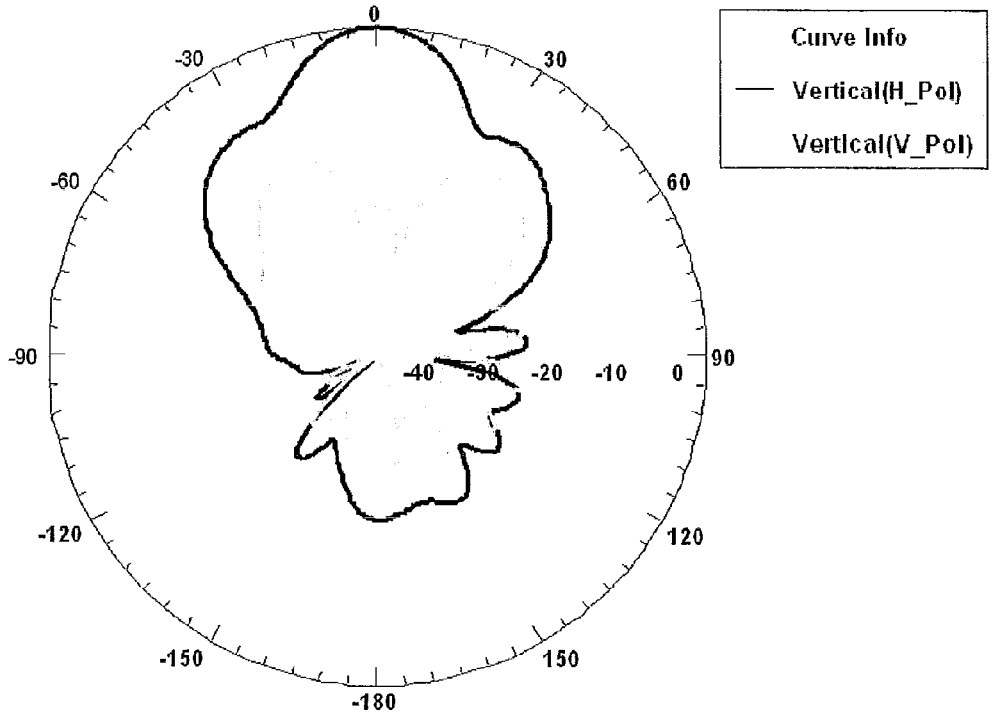

FIGS. 15A and 15B show the radiation characteristics when the notched portion 37 is formed. Here, the number of the notches 37 is three, and the positions of the three notches 37 are at ¼, ⅔, and ¾ of the entire length of the shield portion 33 from the end in the y-axis direction. The length of the notched portion 37 in the y-axis direction is 20 mm. The length of the notched portion 37 is shorter than 21.67 mm which is an interval of the branch lines 23*b*. FIGS. 16A and 16B show the radiation characteristics when the upper plate 34 is not provided but the rear plate 36 is provided. The conditions of the simulations are the same as the simulation conditions described above except that the gap D is set to λ/4.

FIGS. 8A and 8B, and 16A and 16B show the results in which the electromagnetic waves radiated to the rear obliquely upward (in a range of about 100° to 180°) increase in the directivity in the x-z plane when the upper plate 34 is not provided.

On the other hand, FIGS. 8A and 8B, and 15A and 15B show the results in which the directivity hardly changes even if the notched portion 37 is formed or not.

The above results show that the upper plate 34 is necessary to prevent the electromagnetic waves inside the shield portion 33 from radiating to the outside, and even if a gap or hole having a size of the notched portion 37 is formed in the upper plate 34, the electromagnetic waves inside the shield portion 33 hardly leak to the outside through the hole.

Although the simulation results are omitted herein, the directivities will substantially be the same if the number of the notches 37 is set to one or two, or if the notched portion 37 is not formed at all.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims, including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "includes," "comprising," "has," "having," "includes," "including," "contains," "containing" or any other variation thereof, are intended to cover a non-exclusive inclusion, such that a process, method, article, or apparatus that includes, has, includes, contains a list of elements does not include only those elements but may include other elements not expressly listed or inherent to such process, method, article, or apparatus. An element proceeded by "includes . . . a," "has . . . a," "includes . . . a," "contains . . . a" does not, without more constraints, preclude the existence of additional identical elements in the process, method, article, or apparatus that includes, has, includes, contains the element. The terms "a" and "an" are defined as one or more unless explicitly stated otherwise herein. The terms "substantially," "essentially," "approximately," "approximately" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

What is claimed is:

1. An antenna device, comprising:

a horn having a deeper-side portion and an opening-side portion the opening-side portion having a height and a width and the deeper-side portion including a shield portion extending in a direction parallel to the width of the horn;

a feeder line contained within the horn, the feeder line being formed on a substrate and the substrate being arranged parallel to the width of the horn; and an antenna element that is supplied with electric power from the feeder line to generate an electric wave, and radiates the electric wave from the horn, the antenna element being disposed within the horn, wherein the antenna element and a part of the feeder line are arranged in a first plane; and the feeder line contained within the horn and connected to the antenna element is arranged parallel to the radiating direction of the electric wave;

the shield portion covering the feeder line, and the shield portion including a first conductive plate portion arranged so as to oppose an area where the feeder line is formed; and a second conductive plate portion arranged so as to oppose the first plate portion with the substrate interposed therebetween such that a size of a gap formed between the substrate and the first conductive plate portion is at least 1/10 of the wavelength of the radiated electromagnetic wave.

2. The antenna device according to claim 1, wherein the antenna element is a dipole antenna including a pair of antenna elements formed on the substrate.

3. The antenna device according to claim 1, wherein the substrate is mounted to the second plate portion.

4. The antenna device according to claim 3, wherein the horn includes a third plate portion coupled to end portions of the first plate portion and the second plate portion on the side opposite from the open direction of the horn.

5. The antenna device according to claim 1, wherein at least a part of the feeder line is covered with an insulator.

6. An antenna device according to claim 1, wherein the antenna element is arranged perpendicular to the radiating direction of the electric wave.

7. An antenna device according to claim 6, further comprising:

a feeder pipe vertically arranged, wherein the first plane is horizontally arranged.

8. An antenna device according to claim 7, further comprising:

a plurality of antenna elements, and a plurality of feeder lines, wherein the antenna elements and part of each of the feeder lines are in the first plane, and a part of each of the feeder lines are connected to the antenna elements and arranged parallel to the radiating direction of the electric wave.

9. The antenna device of claim 1, where the feeder line includes a trunk line and a branch line, the trunk line being the part of the feeder line arranged in the first plane and the branch line being the feeder line connected to the antenna element; and the branch line connecting the antenna element and the trunk line.

10. The antenna device of claim 1, wherein the shield portion is arranged on an opposite side of the opening-side portion;

the antenna element is arranged in a first plane to generate the electric wave radiated from the horn, at least a part of the first plane being contained within the shield portion;

the feeder line is arranged in the first plane;

the feeder line is electrically insulated from the horn;

the feeder line is connected to the antenna element in parallel with the radiating direction of the electric wave.

11. An antenna device according to claim 10, wherein the antenna element has at least one dipole antenna formed on a substrate.

12. A radar apparatus, comprising:

a horn having a deeper-side portion and an opening-side portion the opening-side portion having a height and a width and the deeper-side portion including a shield portion extending in a direction parallel to the width of the horn;

a feeder line contained within the horn, the feeder line being formed on a substrate and the substrate being arranged parallel to the width of the horn;

an antenna element that is supplied with electric power from the feeder line to generate an electric wave, and radiates the electric wave from the horn, and which lies within the horn and with the feeder line within a first plane; and a reception portion for receiving a reflective wave of the electromagnetic wave from a target object;

the feeder line being arranged parallel to the radiating direction of the electric wave;

the shield portion covering the feeder line, and the shield portion including a first conductive plate portion arranged so as to oppose an area where the feeder line is formed; and a second conductive plate portion arranged so as to oppose the first plate portion with the substrate interposed therebetween such that a size of a gap formed between the substrate and the first conductive plate portion is at least 1/10 of the wavelength of the radiated electromagnetic wave.

13. The radar apparatus according to claim 12, wherein the antenna element is a dipole antenna including a pair of antenna elements formed on the substrate.

14. The radar apparatus according to claim 12, wherein the substrate is mounted to the second plate portion.

15. The radar apparatus according to claim 14, wherein the horn includes a third plate portion coupled to end portions of the first plate portion and the second plate portion on the side opposite from the open direction of the horn.

16. The radar apparatus according to claim 12, wherein at least a part of the feeder line is covered with an insulator.

17. The radar apparatus of claim 12, where the feeder line includes a trunk line and a branch line, the trunk line being that portion of the feeder line that lies with the antenna element within the first plane;

the branch line being that portion of the feeder line arranged parallel to the radiating direction of the electric wave; and the branch line connecting the antenna element and the trunk line.

18. An antenna device, comprising:

a horn having a deeper-side portion and an opening-side portion, the opening-side portion having a height and a width and the deeper-side portion including a shield portion extending in a direction parallel to the width of the horn;

a plurality of antenna elements disposed inside the horn at the deeper-side portion;

a feeder line disposed inside the horn at the deeper-side portion, the feeder line configured to supply electric power to the antenna elements, the feeder line including a trunk line and a plurality of branch lines extending from the trunk line, each branch line connecting the trunk line to an antenna element;

the antenna elements being configured to generate an electric wave using the supplied electric power, and radiate the generated electric wave from the horn;

the antenna elements and the trunk line being arranged along an axis extending in a direction parallel to the width of the horn;

the branch lines being arranged in a direction parallel to a radiating direction of the electric wave;

the plurality of antenna elements and the feeder line being formed on a substrate and the substrate being arranged in the direction parallel to the width of the horn;

the shield portion covering the feeder line;

the shield portion including a first conductive plate portion arranged so as to oppose an area where the feeder line is formed; and a second conductive plate portion arranged so as to oppose the first plate portion, the first and second conductive plates opposing each-other along a direction parallel to the height of the horn with the substrate interposed therebetween such that a size of a gap formed between the substrate and the first conductive plate portion is at least 1/10 of the wavelength of the radiated electromagnetic wave.

19. The antenna device of claim 18, further comprising a reception portion configured to receive a reflection of the radiated electromagnetic wave from a target object.

20. The antenna device according to claim 18, further comprising a dipole antenna that includes a pair of antenna elements formed on the substrate.

21. The antenna device according to claim 18, the shield portion including:

a first side-plate disposed at one end of the shield portion; and a second side-plate disposed at an other end of the shield portion;

the first side plate and second side plate being separated by the width of the horn;

the first side plate and second side plate being arranged perpendicular to the direction of the width of the horn; and the substrate being disposed in an area defined by the first conductive plate, the second conductive plate, the first side plate, and the second side plate.

22. An antenna device, comprising:

a horn including an opening-side portion, a deeper-side portion and a shield portion arranged on opposite side of the opening-side portion, the opening-side portion having a height and a width and the shield portion extending in a direction parallel to the width of the horn;

an antenna element arranged within the horn in a first plane to generate the electric wave radiated from the horn, at least a part of the first plane being contained within the shield portion; and a feeder line arranged within the horn in the first plane, electrically insulated from the horn and connected to the antenna element in parallel with the radiating direction of the electric wave, to supply with electric power to the antenna element;

the feeder line being formed on a substrate and the substrate being arranged parallel to the width of the horn;

the shield portion covering the feeder line, the shield portion including a first conductive plate portion arranged so as to oppose an area where the feeder line is formed; and a second conductive plate portion arranged so as to oppose the first plate portion with the substrate interposed therebetween such that a size of a gap formed between the substrate and the first conductive plate portion is at least 1/10 of the wavelength of the radiated electromagnetic wave.

* * * * *